US012577034B2

(12) United States Patent
Cho et al.

(10) Patent No.: US 12,577,034 B2
(45) Date of Patent: Mar. 17, 2026

(54) AEROSOL SAFETY ACTUATOR

(71) Applicant: AptarGroup Inc., Cary, IL (US)

(72) Inventors: Sean Cho, Elgin, IL (US); Gerald J. Marquardt, Elgin, IL (US); Gregory A. Erickson, Wheaton, IL (US)

(73) Assignee: APTARGROUP INC.

( * ) Notice: Subject to any disclaimer, the term of this patent is extended or adjusted under 35 U.S.C. 154(b) by 115 days.

(21) Appl. No.: 18/233,955

(22) Filed: Aug. 15, 2023

(65) Prior Publication Data

US 2024/0051731 A1 Feb. 15, 2024

Related U.S. Application Data

(60) Provisional application No. 63/398,034, filed on Aug. 15, 2022.

(51) Int. Cl.
*B65D 83/20* (2025.01)
*B65D 83/22* (2025.01)

(52) U.S. Cl.
CPC ..... *B65D 83/20* (2013.01); *B65D 83/22* (2013.01)

(58) Field of Classification Search
CPC ..... B65D 83/20; B65D 83/22
See application file for complete search history.

(56) References Cited

U.S. PATENT DOCUMENTS

| | | | | |
|---|---|---|---|---|
| 3,860,149 | A | 1/1975 | Hagianis | |
| 7,487,891 | B2 | 2/2009 | Yerby | |
| 8,100,298 | B2 | 1/2012 | Marquardt | |
| 8,127,968 | B2 | 3/2012 | Yerby | |
| 9,216,852 | B2 * | 12/2015 | Cho | B65D 83/22 |
| 10,435,227 | B2 | 10/2019 | Erickson | |
| 10,591,337 | B1 | 3/2020 | Neuhalfen | |
| D960,704 | S | 8/2022 | Henkel | |
| 11,565,873 | B2 | 1/2023 | Erickson | |
| 2007/0235474 | A1 | 10/2007 | Downey et al. | |

(Continued)

FOREIGN PATENT DOCUMENTS

| | | | |
|---|---|---|---|
| JP | 2016130142 | A | 7/2016 |
| WO | WO 2024/039629 | A2 | 2/2024 |
| WO | WO 2024/039632 | A1 | 2/2024 |

OTHER PUBLICATIONS

U.S. Appl. No. 29/849,830, Aptargroup Inc.

*Primary Examiner* — Timothy L Maust
(74) *Attorney, Agent, or Firm* — Frijouf, Rust & Pyle, P.A.

(57) ABSTRACT

An actuator is disclosed for actuating an aerosol valve for dispensing an aerosol product from an aerosol container. The actuator comprises an actuator button being rotatable relative to a base for movement between a locked rotational position stop and an unlocked rotational position stop. The actuator button is movable relative to the base for actuating the aerosol valve to dispense the aerosol product when the actuator button is rotated into a unlocked rotational position. The actuator button is inhibited from actuating the aerosol valve when the actuator button is moved into a locked rotational position. In one embodiment, an arcuate projection inhibits unintended movement of the actuator button between the unlocked rotational position and the locked rotational position. In another embodiment, a linear projection inhibits unintended movement of the actuator button between the unlocked rotational position and the locked rotational position.

13 Claims, 23 Drawing Sheets

(56) References Cited

U.S. PATENT DOCUMENTS

| | | | |
|---|---|---|---|
| 2008/0164285 | A1 | 7/2008 | Hygema |
| 2012/0187154 | A1 | 7/2012 | Benson et al. |
| 2014/0124539 | A1 | 5/2014 | Cho et al. |
| 2014/0329918 | A1 | 11/2014 | Arora et al. |
| 2018/0200738 | A1 | 7/2018 | Fore |
| 2024/0051731 | A1 | 2/2024 | Cho |
| 2024/0051732 | A1 | 2/2024 | Cho et al. |

* cited by examiner

Prior Art

Prior Art

Prior Art

Prior Art

Prior Art

Prior Art

Prior Art

Prior Art

Prior Art

Prior Art

Prior Art

Prior Art

Prior Art

Prior Art

Prior Art

Prior Art

Prior Art

Prior Art

AEROSOL SAFETY ACTUATOR

CROSS-REFERENCE TO RELATED APPLICATIONS

This application claims benefit of U.S. Patent Provisional application No. 63/398,034 filed Aug. 15, 2022. All subject matter set forth in provisional application No. 63/398,034 is hereby incorporated by reference into the present application as if fully set forth herein.

BACKGROUND OF THE INVENTION

Field of the Invention

This invention relates to dispensing of an aerosol product and more particularly to an improved aerosol actuator having an actuator button being rotatable relative to a base for enabling and inhibiting the dispensing of the aerosol product from an aerosol container and incorporating a safety actuator.

Description of the Related Art

An aerosol dispenser comprises an aerosol product and an aerosol propellant contained within an aerosol container. An aerosol valve is provided to control the discharge of the aerosol product from the aerosol container through the fluid pressure provided by the aerosol propellant.

The aerosol valve is biased into a closed position. A valve stem cooperates with the aerosol valve for opening the aerosol valve. An actuator engages with the valve stem to open the aerosol valve for dispensing the aerosol product and the aerosol propellant from the aerosol container. The aerosol product and the aerosol propellant are dispensed from the aerosol valve through a spray nozzle. Typically, the aerosol product and the aerosol propellant are contained in a common portion of the aerosol container.

In some occasions, an invention results in products that have desirable characteristics resulting in wide spread use and universal acceptance in a marketplace. These illusive desirable characteristics are the result of a combination of elements that collectively work together to produce the totality of the product. Like all successful products, a successful product may be further improved in one or more aspects of the product.

One specific example of an aerosol product that has achieved wide spread use and universal acceptance in a marketplace is an aerosol actuator sold under the trademark Moritz by the Aptargroup, Inc. This aerosol actuator was the subject matter of U.S. Pat. No. 7,487,891.

The Moritz aerosol actuator includes an actuator button orifice defined in the sidewall of the actuator button. The actuator button is rotatable relative to a base for movement between a locked rotational position and an unlocked rotational position. The actuator button is tiltable relative to the base for actuating the aerosol valve to dispense the aerosol product from a terminal orifice and through the actuator button orifice when the actuator button is rotated into the unlocked rotational position. The actuator button is inhibited from actuating the aerosol valve when the actuator button is moved into the locked rotational position whereat the actuator button orifice is moved away from the terminal orifice.

Although the Moritz aerosol actuator achieved wide spread use and universal acceptance in a marketplace, further improvement may be made to this successful product.

Firstly, in some instances, the actuator button orifice could be slightly misaligned from the terminal orifice in the unlocked rotational position by an unintended movement of the actuator button. This slight defect only related to the appearance of the actuator and did not affect the function of the Moritz aerosol actuator Secondly, the many retail home delivery retail vendors required a strict non-spill requirement of all liquid products. In many cases, this non-spill requirement of liquid products was solved by overwrapping the product with a plastic covering. This plastic covering significantly added to the overall cost of the product.

Thirdly, many manufactures of aerosol products desired to ship the aerosol products in a stacked shipping container. This stacking of the aerosol products in a shipping container raised the concern of accidental actuator of the aerosol product during shipping and delivery.

Therefore, it is an object of the present invention make improvements to the aerosol actuators of the prior art by providing an aerosol safety actuator that overcome the difficulties set forth above and provides an advancement to the aerosol dispensing art.

Another object of the invention is to provide an aerosol safety actuator that inhibits the unintentional misalignment between the actuator button orifice and the terminal orifice in the unlocked rotational position.

Another object of the invention is to provide an aerosol safety actuator that provides a secondary accurate projection coacting between the base and the actuator button for inhibiting unintended movement of said actuator button from the locked rotational position.

Another object of the invention is to provide an aerosol safety actuator that provides an arcuate projection coacting between the base and the actuator button for inhibiting accidental action of the aerosol valve.

Another object of the invention is to provide an aerosol safety actuator that provides does not change the outward appearance of the original aerosol actuator.

Another object of the invention is to provide an aerosol safety actuator that made be undertaken with a simple modification of existing manufacturing tooling.

Another object of the invention is to provide an aerosol safety actuator that made be undertaken without any major increase in material manufacturing cost.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved safety actuator for actuating an aerosol valve for dispensing an aerosol product from an aerosol container. The improved safety actuator comprises a base having an axis of symmetry of the base and a mounting for securing the base to the aerosol container. A nozzle defining a nozzle channel extends between the aerosol valve and a terminal orifice. The nozzle is flexibly mounted to the base for enabling the nozzle to pivot for actuating the aerosol valve. A unitary actuator button comprises a rigid sidewall supporting a rigid top actuating surface with an actuator button orifice defined in the sidewall of the actuator button. The actuator button is rotatably mounted to the base to cover the nozzle. The actuator button is rotatable about the axis of symmetry of the base between a locked rotational position and an unlocked rotational position. The actuator button orifice of the actuator button is aligned with the terminal orifice of the nozzle when the actuator button is rotated into the unlocked rotational position. The unitary actuator button is movable relative to the base for engaging and pivoting the nozzle button to actuate the aerosol valve for dispensing aerosol product from the terminal orifice and through the actuator button orifice defined in the sidewall of the actuator button when the actuator button is in the unlocked rotational position. The unitary actuator button is inhibited from pivoting the nozzle button when the actuator button is rotated into the locked rotational position. An arcuate projection having an unlocked cam shape edge and a locked cam shape edge coacts between the base and the actuator button for inhibiting unintended movement of the actuator button between the unlocked rotational position and the locked rotational position.

In a more specific example, the arcuate projection is unitary with the base and extends radially outwardly relative to the axis of symmetry of the base. The arcuate projection has an arc angle substantially similar to an angle of rotational of the actuator button relative to the base. The unlocked cam shape edge and a locked cam shape edge engage with a rib extending from an underside of the actuator button for inhibiting unintended movement of the actuator button between the unlocked rotational position and the locked rotational position. Preferably, the rib extending is unitary with the actuator button.

In another more specific example, the improved safety actuator includes an unlocked rotational position stop and a locked rotational position stop for limiting rotational movement of the actuator button relative to the base. The unlocked cam shape edge engages with a rib extending from an underside of the actuator button and cooperating with the unlocked rotational position stop to secure the actuator button in the unlocked rotational position. The locked cam shape edge engages with a rib extending from an underside of the actuator button and cooperating with the locked rotational position stop to secure the actuator button in the locked rotational position.

In another embodiment, the invention relates to an improved safety actuator for actuating an aerosol valve for dispensing an aerosol product from an aerosol container. The improved safety actuator comprises a base having an axis of symmetry of the base and a mounting for securing the base to the aerosol container. A nozzle defining a nozzle channel extends between the aerosol valve and a terminal orifice. The nozzle is flexibly mounted to the base for enabling the nozzle to pivot for actuating the aerosol valve. A unitary actuator button comprises a rigid sidewall supporting a rigid top actuating surface with an actuator button orifice defined in the sidewall of the actuator button. The actuator button is rotatably mounted to the base to cover the nozzle. The actuator button is rotatable about the axis of symmetry of the base between a locked rotational position and an unlocked rotational position. The actuator button orifice of the actuator button is aligned with the terminal orifice of the nozzle when the actuator button is rotated into the unlocked rotational position. The unitary actuator button is movable relative to the base for engaging and pivoting the nozzle button to actuate the aerosol valve for dispensing aerosol product from the terminal orifice and through the actuator button orifice defined in the sidewall of the actuator button when the actuator button is in the unlocked rotational position. The unitary actuator button is inhibited from pivoting the nozzle button when the actuator button is rotated into the locked rotational position. A linear projection coacts between the base and the actuator button for inhibiting unintended movement of the actuator button between the unlocked rotational position and the locked rotational position.

In a more specific example, the linear projection may be unitary with the actuator button or in the alternative may be unitary with the base. In either event, the actuator button substantially parallel with the axis of symmetry of the base. When the linear projection is unitary with the actuator button, the linear projection extends radially inwardly from an inside surface of the actuator button. When the linear projection is unitary with the base, the linear projection extends radially outwardly relative to the axis of symmetry of the base. The linear projection engages with a portion of the base for inhibiting unintended movement of the actuator button between the unlocked rotational position and the locked rotational position. The linear projection may include a plurality of spaced apart linear projections extending radially inwardly from and inside surface of the actuator button and substantially parallel with the axis of symmetry of the base for engaging with a portion of the base for inhibiting unintended movement of the actuator button between the unlocked rotational position and the locked rotational position. The plurality of spaced apart linear projections have an arc spacing commensurate with the angle of rotation between the unlocked rotational position and the locked rotational position.

The linear projection works in concert with an unlocked rotational position stop and a locked rotational position stop for limiting rotational movement of the actuator button relative to the base. The linear projection works in concert with a gap in the base and a unlocked rotational position stop to secure the actuator button in the unlocked rotational position. The linear projection works in concert with a gap in the base and the locked rotational position stop to secure the actuator button in the locked rotational position.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
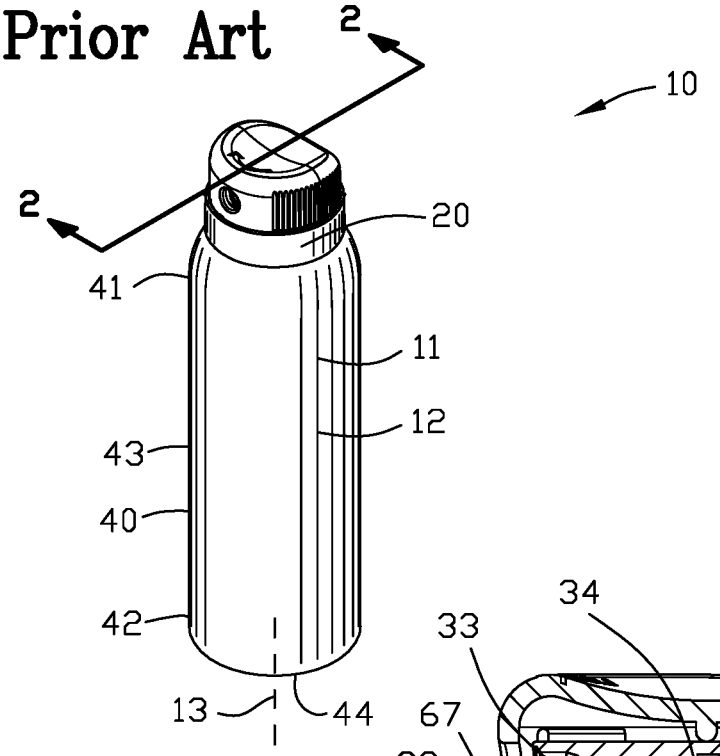
FIG. 1 Prior Art
FIG. 1 is a top isometric view of a prior art actuator of the present invention located on an aerosol container.
Figure 2:
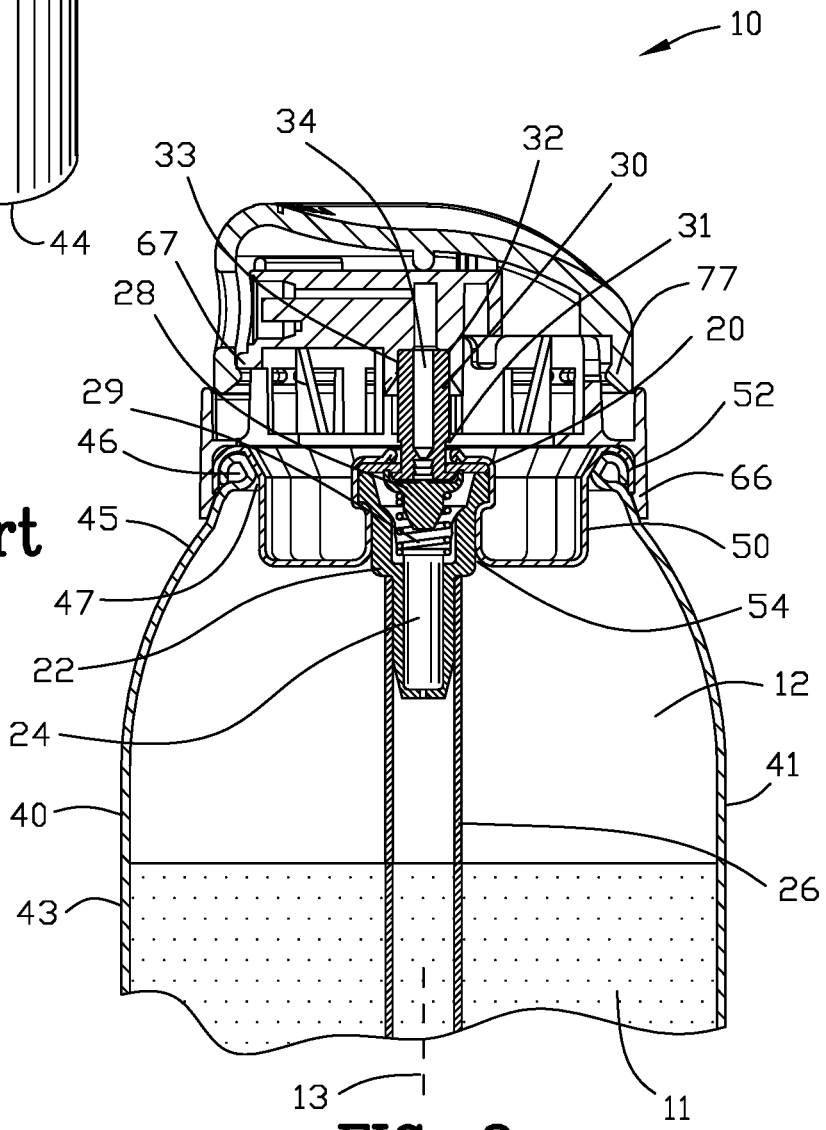
FIG. 2 is an enlarged partial sectional view along line 2-2 in FIG. 1.
Figure 3:
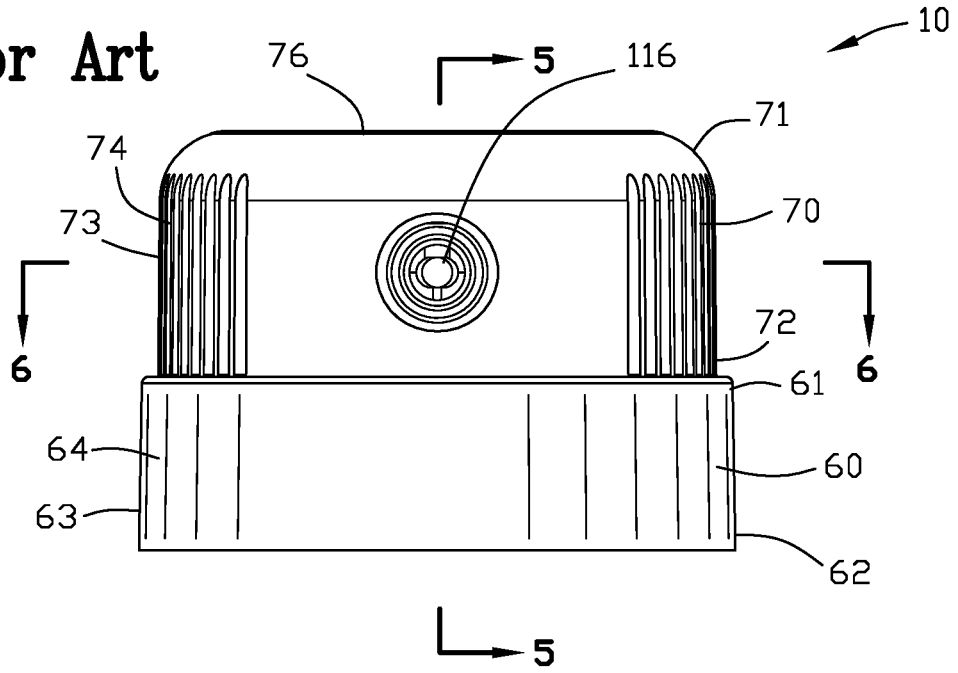
FIG. 3 Prior Art
FIG. 3 is an enlarged front view of the prior art actuator of FIG. 1.
Figure 4:
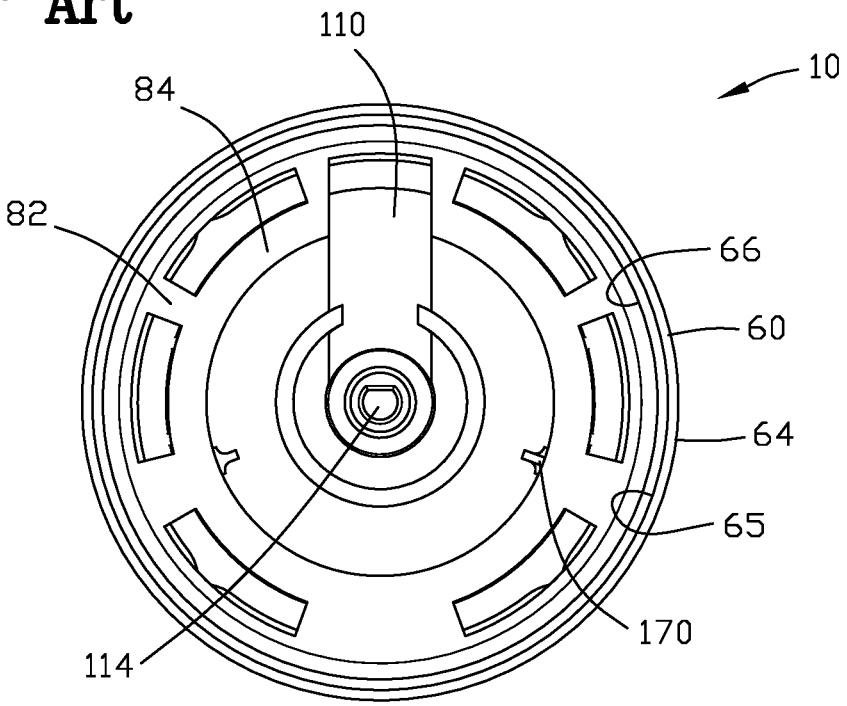
FIG. 4 is a bottom view of FIG. 3.
Figure 5:
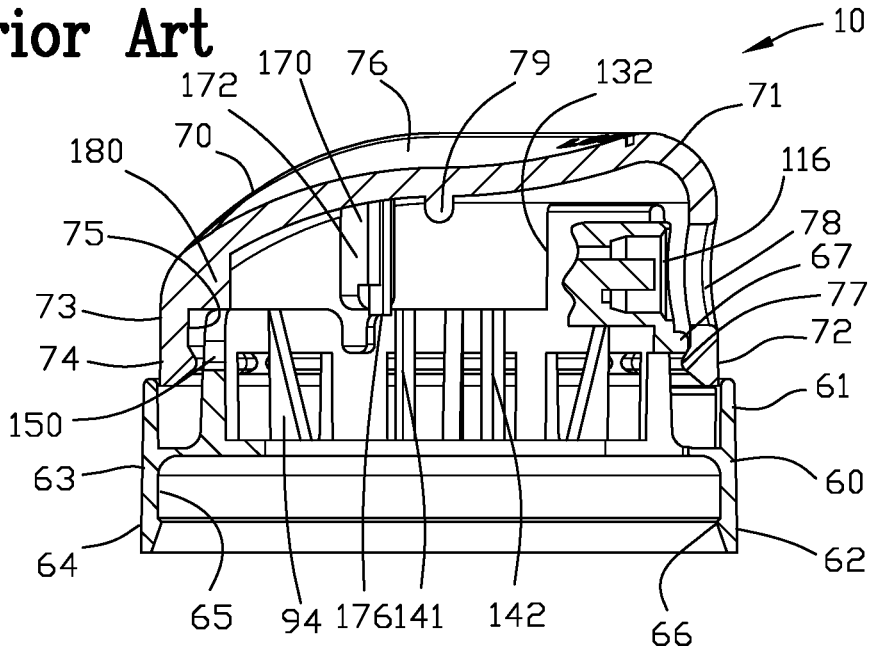
FIG. 5 Prior Art
FIG. 5 is a sectional view along line 5-5 in FIG. 3.
Figure 6:
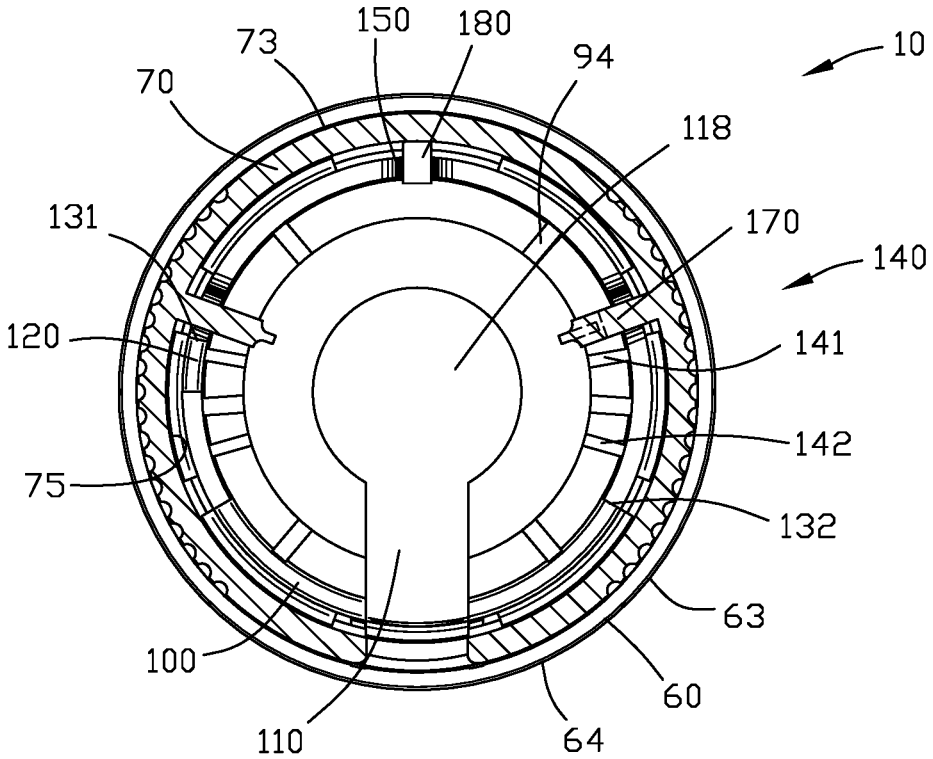
FIG. 6 is a sectional view along line 6-6 in FIG. 3.
Figure 7:
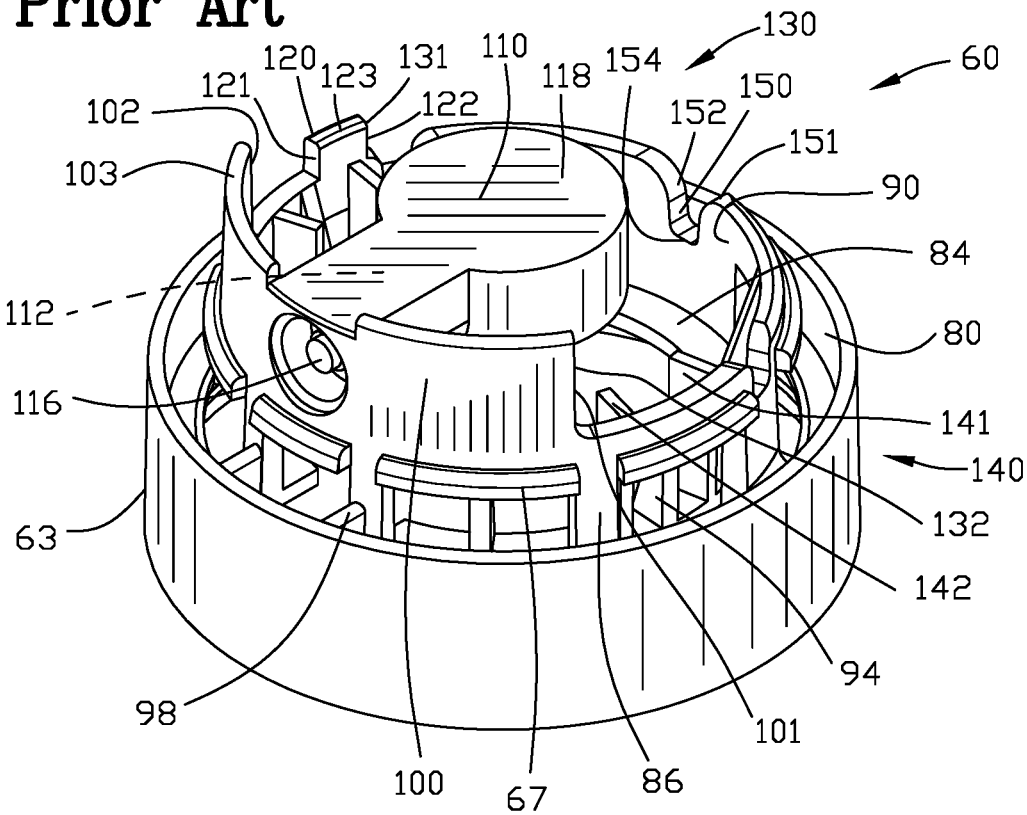
FIG. 7 Prior Art
FIG. 7 is a top isometric view of a base portion of the prior art actuator of FIGS. 1-6.
Figure 8:
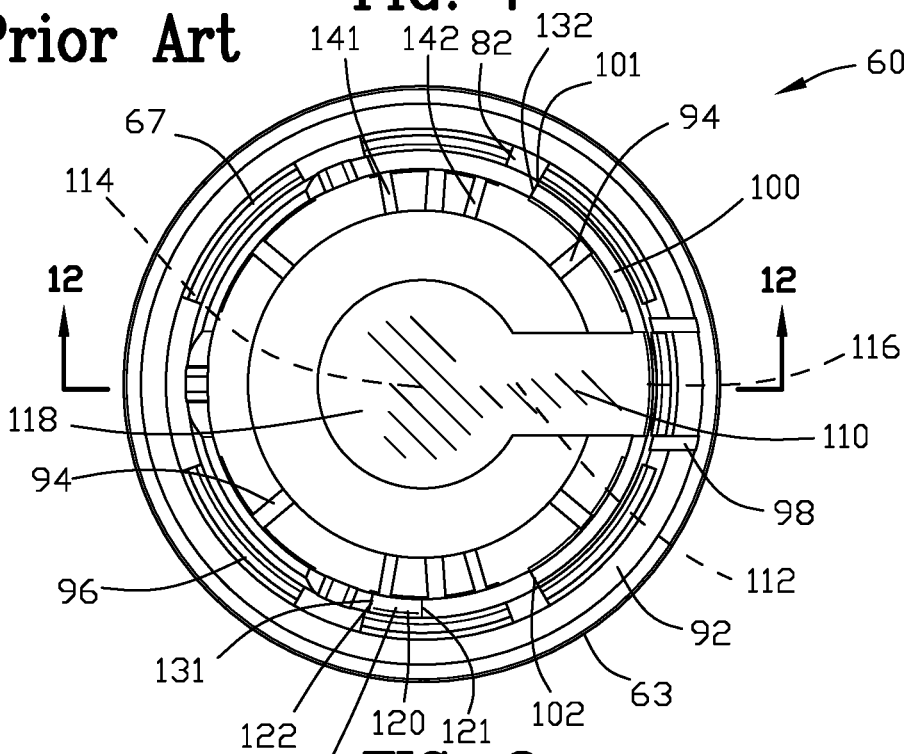
FIG. 8 is a top view of the base shown in of FIGS. 1-6.
Figure 9:
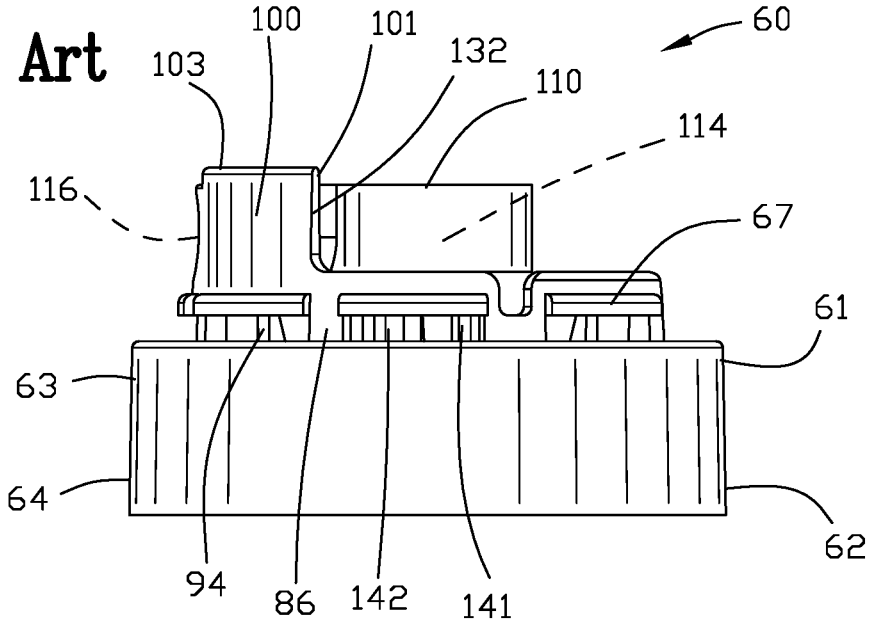
FIG. 9 Prior Art
FIG. 9 is a left side view of the base of FIG. 7.
Figure 10:
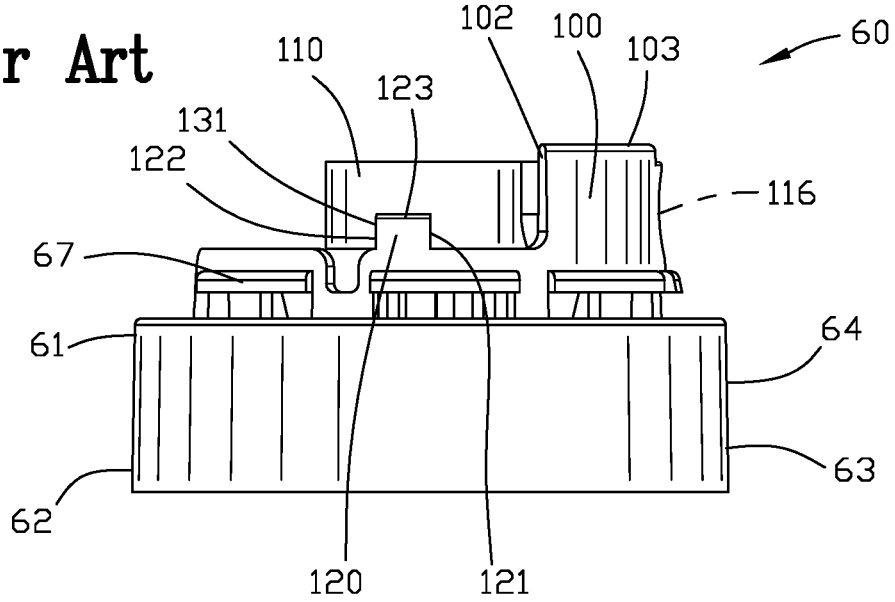
FIG. 10 is a right side view of the base of FIG. 7.
Figure 11:
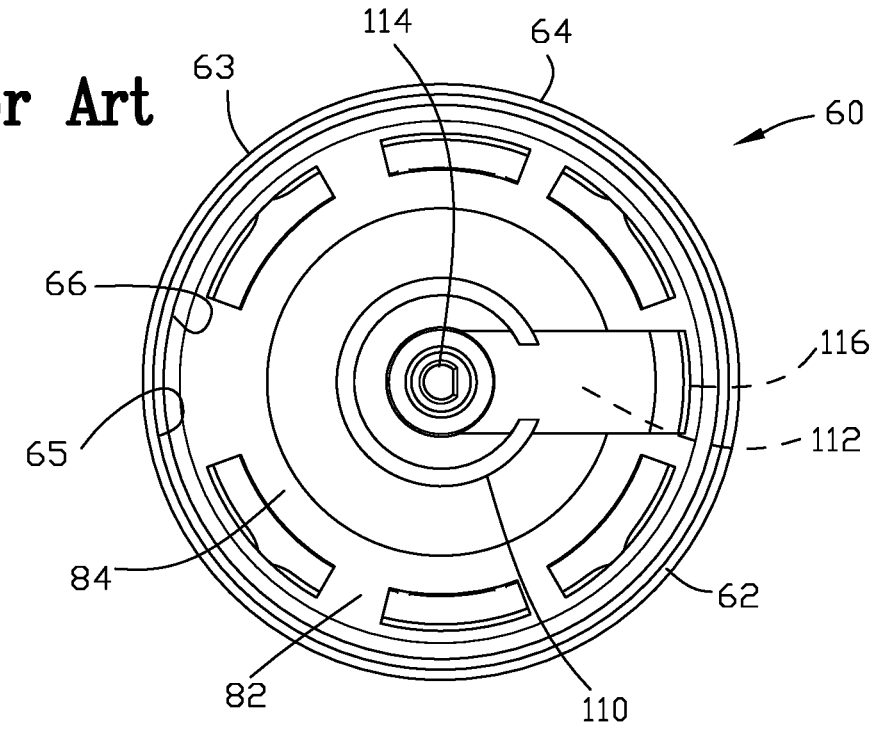
FIG. 11 Prior Art
FIG. 11 is a bottom view of FIG. 8.
Figure 12:
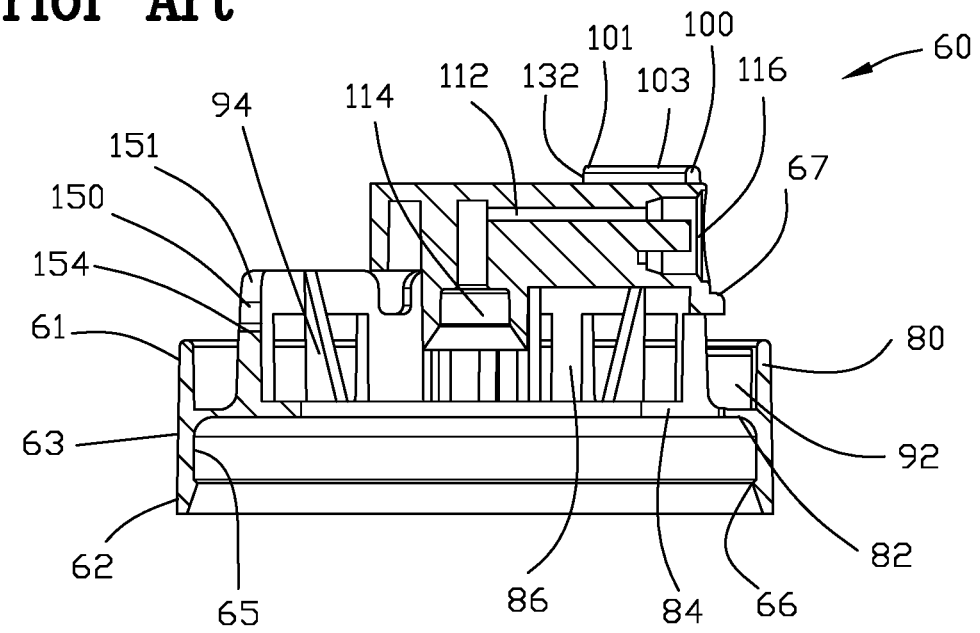
FIG. 12 is a sectional view along line 12-12 in FIG. 8.
Figure 13:
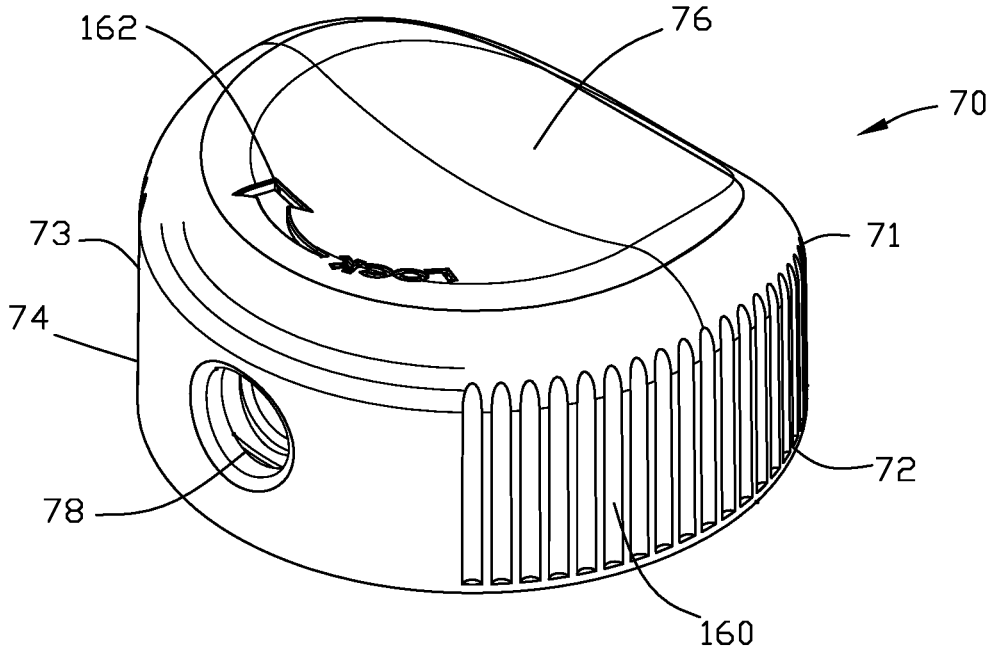
FIG. 13 Prior Art
FIG. 13 is a top isometric view of the actuator button of FIGS. 1-6.
Figure 14:
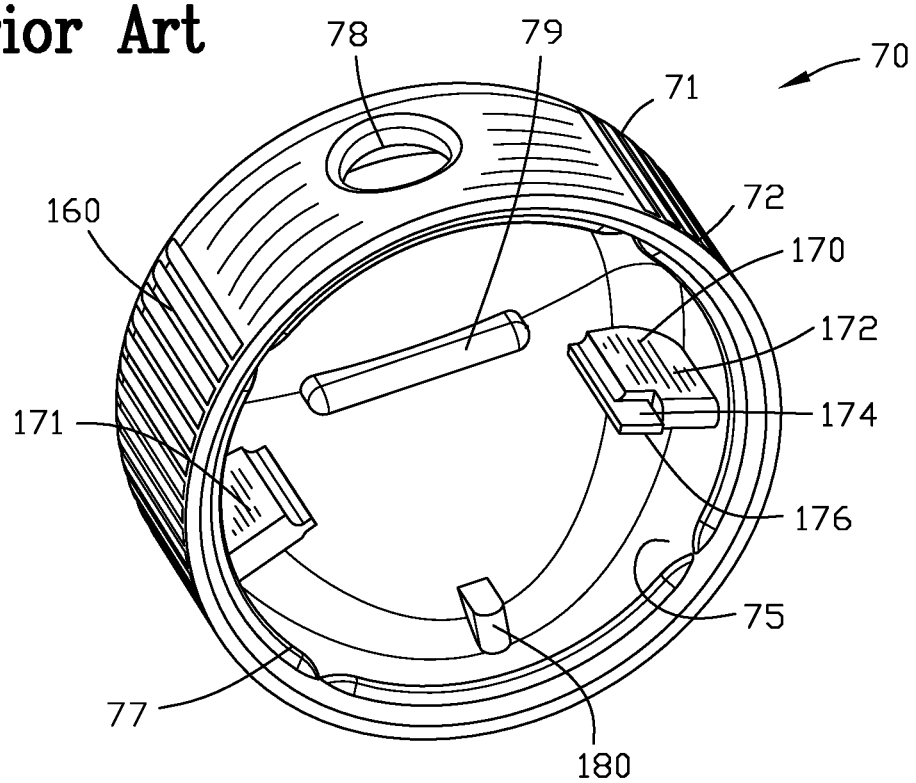
FIG. 14 is a bottom isometric view of the actuator button of FIGS. 1-6.

FIGS. 1 and 2 illustrate a prior art actuator 10 of the present invention for dispensing an aerosol product 11 with an aerosol propellant 12. The prior art aerosol actuator 10 is representative of the prior art aerosol actuator 10 shown in U.S. Pat. No. 7,487,891. A full explanation of the prior art aerosol actuator 10 shown in U.S. Pat. No. 7,487,891 is set forth in FIGS. 1-30 and the related specification.

The prior art actuator 10 defines an axis of symmetry 13. An aerosol valve 20 controls the flow of the aerosol product 11 through a valve stem 30. The aerosol product 11 and the aerosol propellant 12 are stored within an aerosol container 40. The aerosol propellant 12 may be any of the propellants used for aerosol actuators including liquefied propellants such as hydrocarbons and hydrofluorocarbons and any of the compressed gases such as carbon dioxide or nitrogen or any other suitable compressed gas.

The aerosol container 40 is shown as a small aluminum cylindrical container of conventional design and material. Although the aerosol container 40 has been shown as a small aluminum cylindrical container of conventional design, it should be understood that the prior art actuator 10 of the present invention may be used with aerosol containers of various designs.

The aerosol container 40 extends between a top portion 41 and a bottom portion 42 with a cylindrical sidewall 43 located therebetween. The bottom portion 42 of the aerosol container 40 is closed by an endwall 44. The top portion 41 of the aerosol container 40 tapers radially inwardly into a neck 45 terminating in a bead 46. The bead 46 defines an opening 47 in the aerosol container 40 for receiving a mounting cup 50.

The mounting cup 50 includes a peripheral rim 52 for sealing to the bead 46 of the aerosol container 40 in a conventional fashion. The mounting cup 50 includes a turret 54 for receiving the aerosol valve 20.

The aerosol valve 20 includes a valve body 22 secured to the turret 54 of the mounting cup 50 in a conventional fashion. The valve body 22 defines an internal valve cavity 24 in fluid communication with the aerosol container 40 through a dip tube 26. The aerosol valve 20 includes a valve element 28 positioned within the internal valve cavity 24. A bias spring 29 biases the valve element 28 into a closed position to inhibit the flow of the aerosol product 11 through the valve stem 30.

The valve stem 30 extends between a first end 31 and a second end 32. The valve stem 30 defines an outer surface 33 with a stem passageway 34 extending therein. The stem passageway 34 provides fluid communication to the second end 32 of the valve stem 30 from the aerosol valve 20. The first end 31 of the valve stem 30 interacts with the valve element 28 in a conventional manner. A depression of the valve stem 30 moves the valve element 28 into an open position against the urging of the bias spring 29 to permit the flow of the aerosol product 11 from the second end 32 of the valve stem 30.

Figure 19:
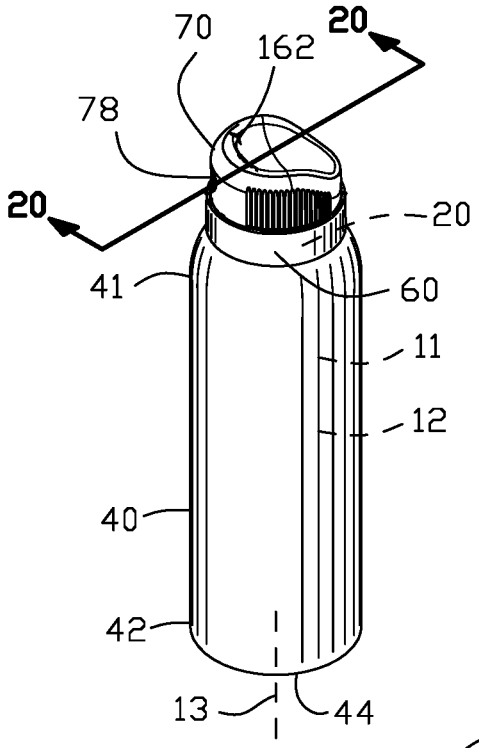
FIG. 19 Prior Art
FIG. 19 is a top isometric view similar to FIG. 1 with the actuator button being located in a locked rotational position.
Figure 20:
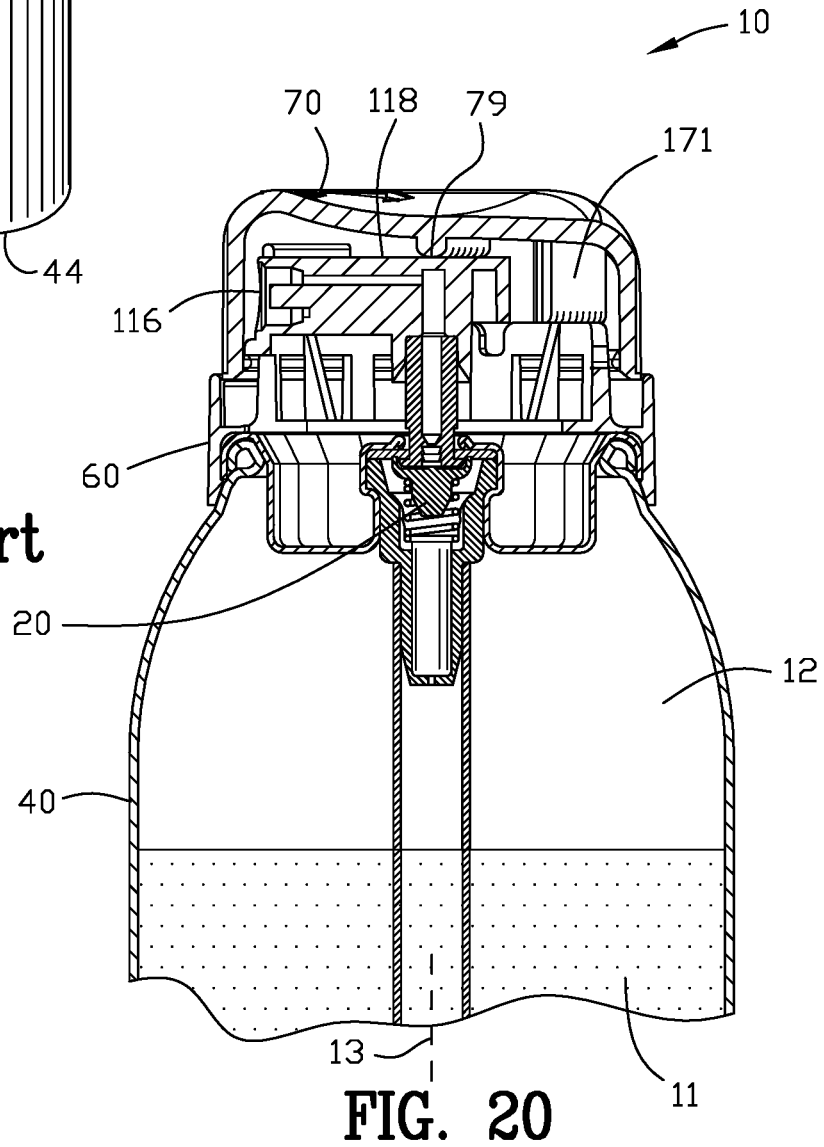
FIG. 20 is an enlarged partial sectional view along line 20-20 in FIG. 19.
Figure 21:
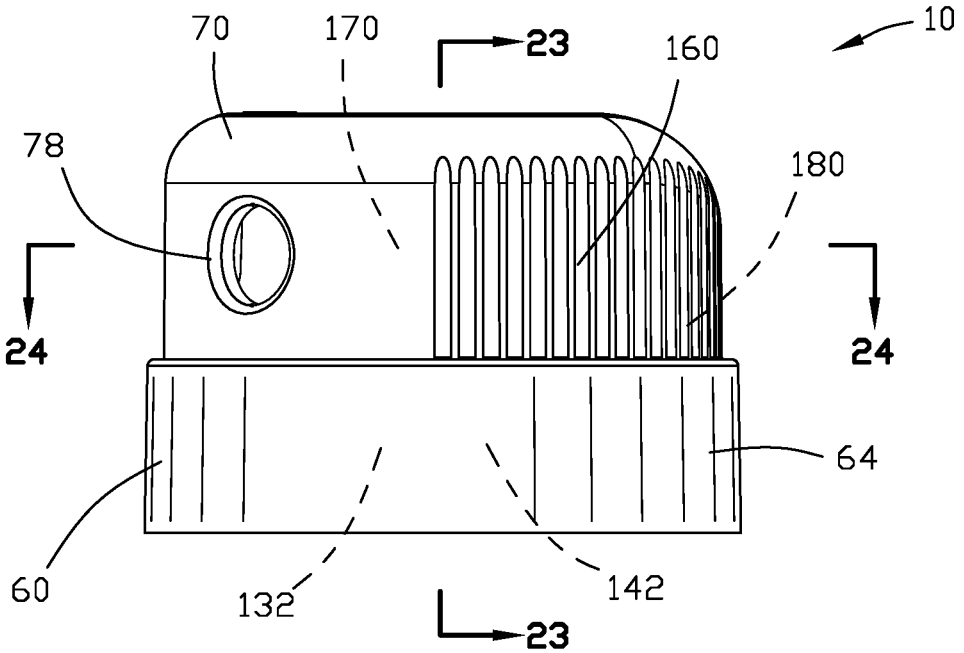
FIG. 21 Prior Art
FIG. 21 is an enlarged front view of the prior art actuator of FIG. 20.
Figure 22:
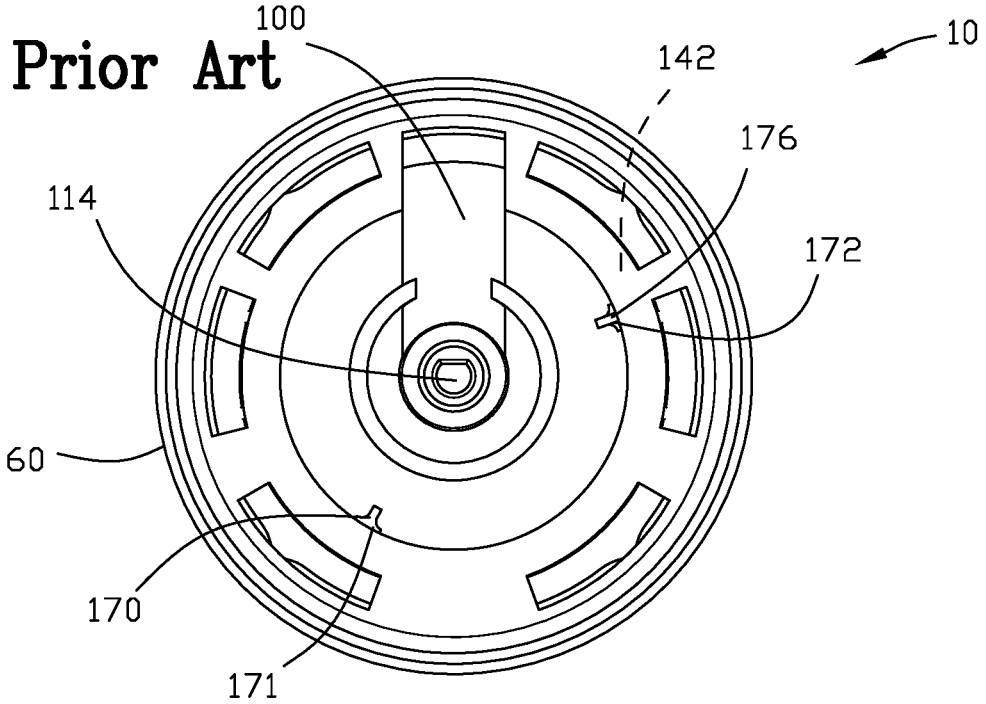
FIG. 22 is a bottom view of FIG. 21.
Figure 23:
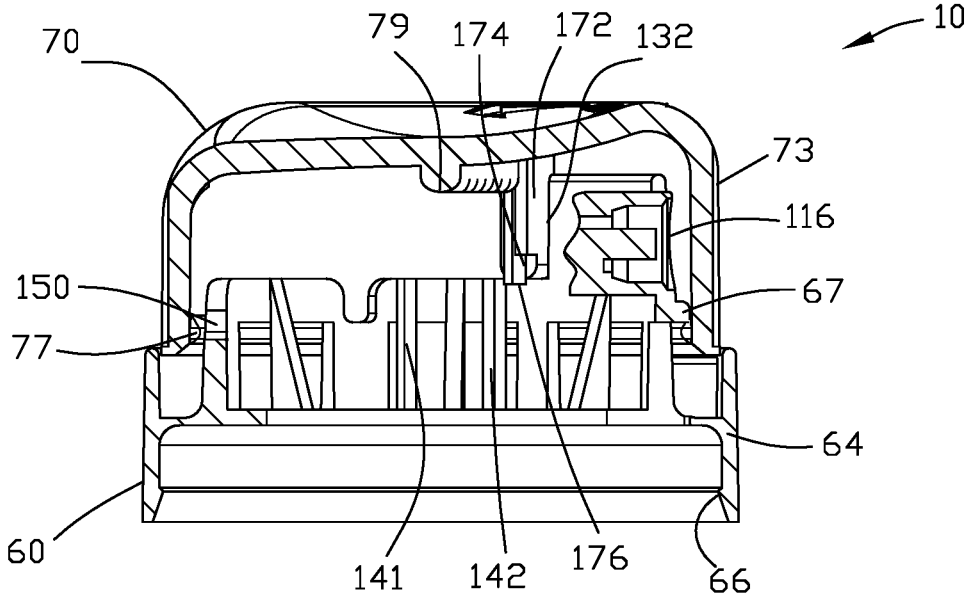
FIG. 23 Prior Art
FIG. 23 is a sectional view along line 23-23 in FIG. 21.
Figure 24:
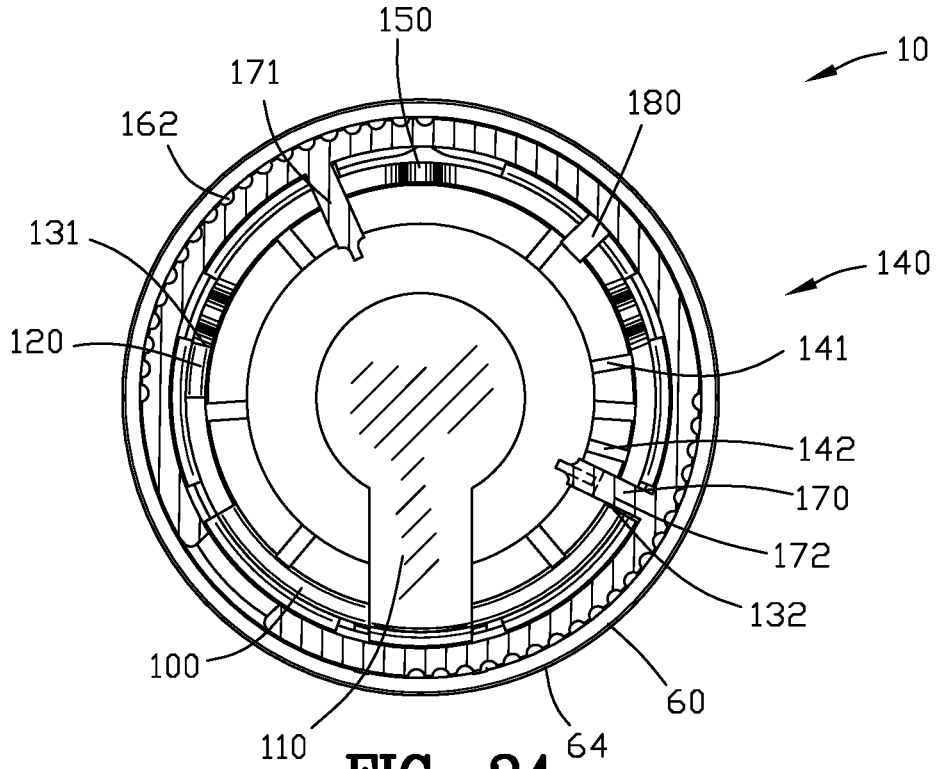
FIG. 24 is a sectional view along line 24-24 in FIG. 21.
Figure 25:
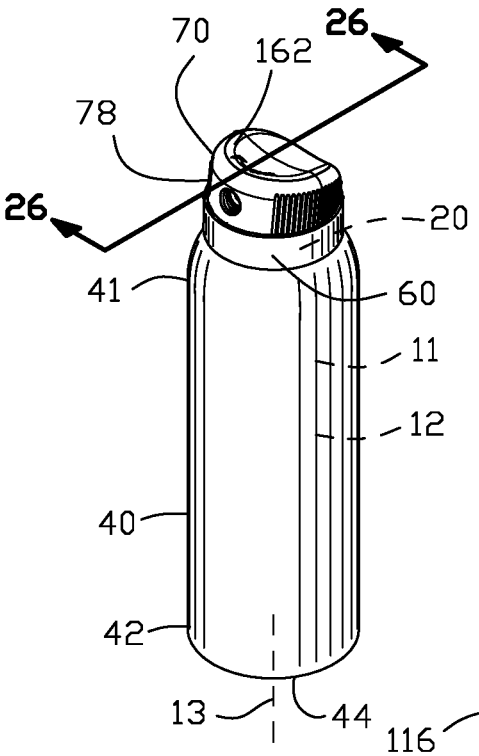
FIG. 25 Prior Art
FIG. 25 is a top isometric view similar to FIG. 1 with the actuator button being located in an unlocked rotational position and in an actuated position.
Figure 26:
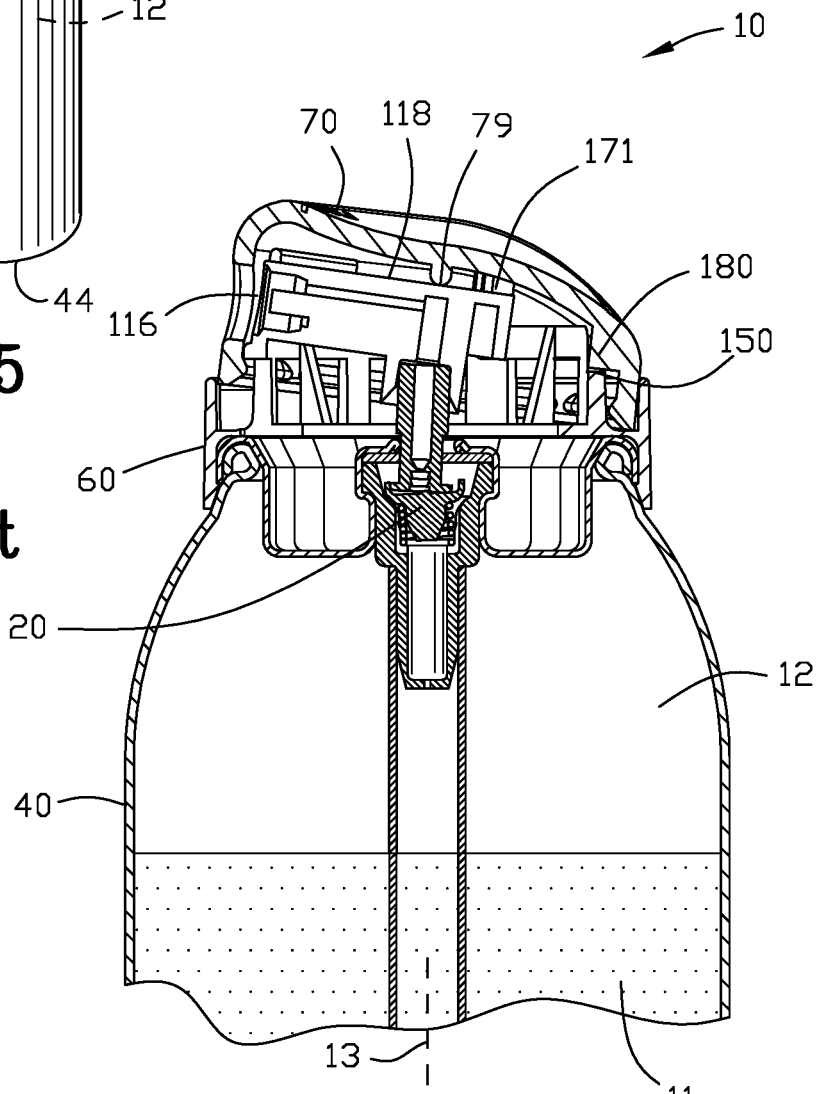
FIG. 26 is an enlarged partial sectional view along line 26-26 in FIG. 25.

FIGS. 3-6 are enlarged views of the prior art actuator 10 of FIGS. 1 and 2. The prior at actuator 10 comprises a base 60 and an actuator button 70. As will be described in greater detail hereinafter, the actuator button 70 is rotatable relative to the base 60 between an unlocked rotational position as shown in FIGS. 1 and 2 and a locked rotational position as shown in FIGS. 19 and 20. The actuator button 70 is movable or tiltable relative to the base 60 as shown in FIG. 26 for actuating the aerosol valve 20 to dispense the aerosol product 11 from the aerosol container 40 when the actuator button 70 is rotated into the unlocked rotational position as shown in FIGS. 1 and 2. The actuator button 70 inhibited from moving or tilting relative to the base 60 as shown in FIG. 20 when the actuator button 70 is moved into the locked rotational position as shown in FIGS. 19 and 20.

The base 60 extends between a top portion 61 and a bottom portion 62 with a cylindrical sidewall 63 located therebetween. The sidewall 63 of the base 60 defines an outer surface 64 and an inner surface 65 coaxial with the axis of symmetry 13 of the actuator 10. The base 60 includes a base mounting 66 for securing the base 60 to the aerosol container 40. The base mounting 66 is shown as a generally annular base projection 66 extending radially inwardly from the inner surface 65 of the base 60 for securing the base 60 to the aerosol container 40. In this example, the base projection 66 engages with the peripheral rim 52 of the mounting cup 50 and/or the bead 46 of the aerosol container 40 in a snap locking engagement. However, it should be understood that the base projection 66 may engage with an annular seam of a conventional larger diameter aerosol container as shown in FIGS. 30-60.

The base 60 includes a base retainer 67 for rotationally securing the actuator button 70 to the base 60. The base retainer 67 comprises a plurality of annular projections 67 extending radially outwardly from the base 60. The plurality of annular projections 67 are distributed about the axis of symmetry 13 of the aerosol actuator 10.

The actuator button 70 is shown as unitary actuator button 70 extending between a top portion 71 and a bottom portion 72 with a cylindrical sidewall 73 located therebetween. The sidewall 73 of the actuator button 70 is a substantially rigid sidewall 73 defining an outer surface 74 and an inner surface 75 coaxial with the axis of symmetry 13 of the actuator 10. The substantially rigid sidewall 73 of the actuator button 70 supports a rigid top actuating surface 76.

The actuator button 70 includes a button retainer 77 for cooperating with the base retainer 67 for rotationally securing the actuator button 70 to the base 60. The button retainer 77 is shown as a plurality of annular projection 77 extending radially inwardly from the inner surface 75 of the sidewall 73 of the actuator button 70. The radially inwardly extending button retainers 77 cooperate with the radially outwardly extending button retainers 67 for rotationally securing the actuator button 70 to the base 60.

The actuator button 70 includes an actuator surface 79 extending from the rigid top actuating surface 76. Preferably, the actuator button 70 is formed of a unitary substantially rigid material for enabling the entirety of the actuator button 70 to tilt as a unit relative to the base 60.

FIGS. 7-12 illustrate various views of the base 60 shown in FIGS. 3-6. The first end 61 of the base 60 defines an outer ring 80. The outer ring 80 is a substantially cylindrical upper portion of the cylindrical sidewall 63. A plurality of radial ribs 82 extend radially inwardly from the inner surface 65 of the cylindrical sidewall 63. The plurality of radial ribs 82 supports base ring 84. The base ring 84 is coaxial with the axis of symmetry 13 of the actuator 10.

A plurality of axial ribs 86 extend axially upwardly from the base ring 84. The plurality of axial ribs 86 extend substantially parallel to and are spaced about the axis of symmetry 13 of the actuator 10. The plurality of axial ribs 86 support an inner ring 90. The inner ring 90 is coaxial with the outer ring 80 forming an annular void 92 therebetween. A plurality of triangularly shaped supporting ribs 94 provide additional support to the inner ring 90 from the base ring 84.

The inner ring 90 includes the base retainer 67 for cooperating with the button retainer 77 for rotationally securing the actuator button 70 to the base 60. The base retainer 67 is shown as a generally annular projection 67 extending radially outwardly from the inner ring 90 of the base 60. Preferably, the inner ring 90 of the base 60 is deformable for enabling the button retainer 77 to pass over the base retainer 67. After the button retainer 77 passes over the base retainer 67, the base retainer 67 engages with the button retainer 77 to retain the actuator button 70 on the base 60. The button retainer 77 of the actuator button 70 interlocks with the base retainer 67 for rotationally securing the actuator button 70 to the base 60.

A bridge 98 extends across the void 92 between the outer ring 80 and the inner ring 90 of the base 60. The bridge 98 extends across a first portion of the inner ring 90 in proximity to the level of the first end 61 of the base 60. The bridge 98 occupies a minor portion of the circumference of the inner ring 90. In this example, the bridge 98 occupies a five to ten degree arc portion of the circumference of the inner ring 90 about the axis of symmetry 13 of the actuator 10.

A flexible wall 100 extends upwardly from the inner ring 90 of the base 60. Preferably, the flexible wall 100 is integrally formed with the inner ring 90 of the base 60. The flexible wall 100 comprises a flexible partially cylindrical wall 100 extending about the axis of symmetry 13 of the actuator 10. The flexible partially cylindrical wall 100 is bounded by a first and a second edge 101 and 102 and a top surface 103.

A nozzle 110 defines a nozzle channel 112 extending between a socket 114 and a terminal orifice 116. The socket 114 is adapted to fractionally receive the second end 32 of the valve stem 30. The nozzle 110 includes a nozzle actuating surface 118 located above the socket 114. The terminal orifice 116 may optionally receive a terminal orifice insert (not shown) for controlling the spray pattern and/or the spray characteristics of the aerosol product 11 being discharged from the actuator 10.

The nozzle 110 is secured to the flexible wall 100 for enabling the nozzle 110 to pivot about the flexible wall 100 upon the flexing or deformation of the flexible wall 100. Preferably, the nozzle 110 is located directly adjacent to the bridge 98 extending across the void 92 between the outer ring 80 and the inner ring 90 of the base 60.

A depression of the nozzle actuating surface 118 enables the nozzle 110 to pivot about the flexible wall 100 to depress the valve stem 30. The depression of the valve stem 30 moves the valve element 28 into an open position to permit the flow of the aerosol product 11 through the stem passage 34 of the valve stem 30 and thorough the nozzle channel 112 of the nozzle 110 for discharge from the terminal orifice 116.

A secondary wall 120 extends upwardly from the inner ring 90 of the base 60. Preferably, the secondary wall 120 is integrally formed with the inner ring 90 of the base 60. The flexible wall 120 is bounded by a first and a second edge 121 and 122 and a top surface 123. In this example, the top surface 103 of the flexible wall 100 extends upwardly a greater distance than the top surface 123 of the secondary wall 120.

Figure 15:
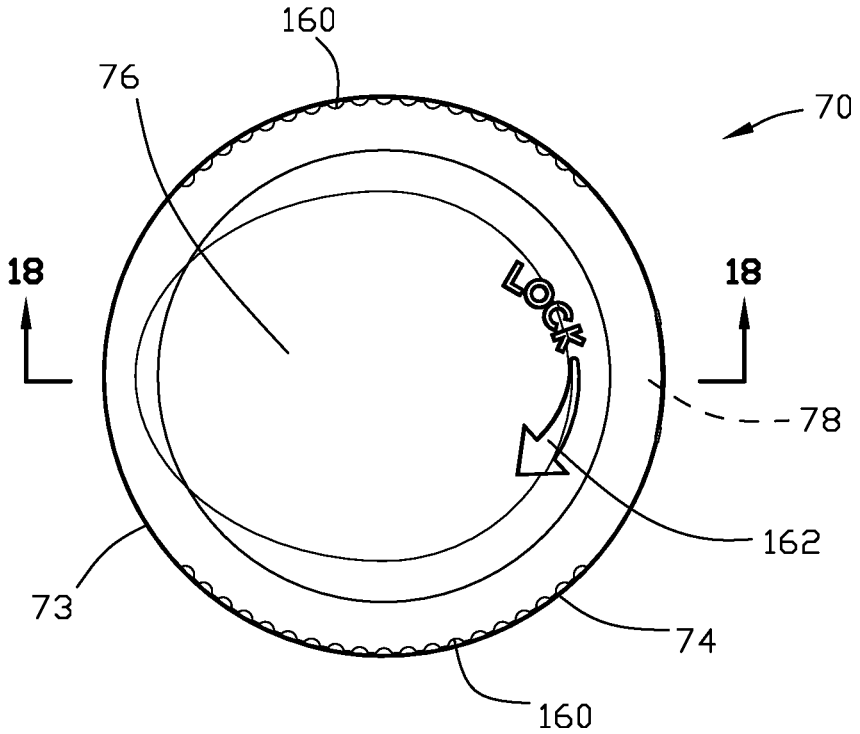
FIG. 15 Prior Art
FIG. 15 is a top view of the actuator button of FIGS. 13-14.
Figure 16:
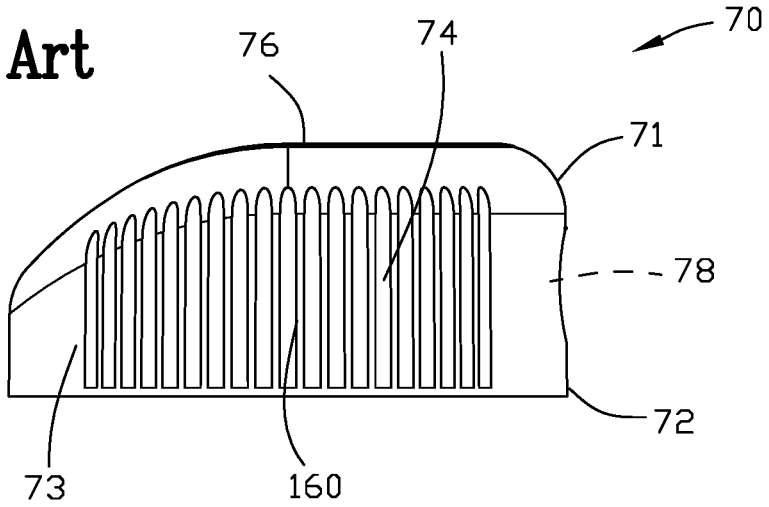
FIG. 16 is a side view of the actuator button of FIG. 15.
Figure 17:
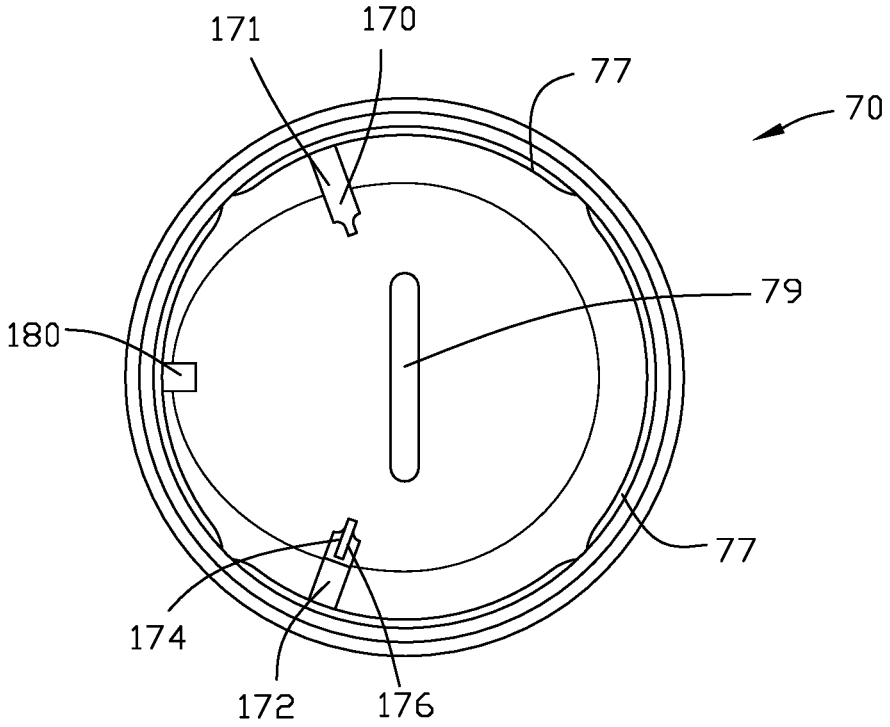
FIG. 17 Prior Art
FIG. 17 is a bottom view of FIG. 16.
Figure 18:
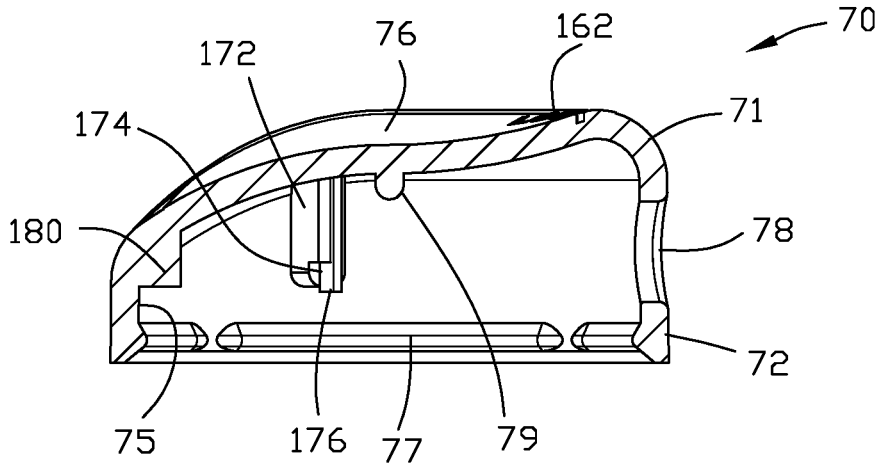
FIG. 18 is a sectional view along line 18-18 in FIG. 15.

The base 60 includes a base stop 130 for cooperating with the actuator button 70 for establishing an unlocked position and a locked rotational position of the actuator button 70 relative to the base 60. More specifically, the base stop 130 includes an unlocked position stop 131 for establishing the unlocked rotational position of the actuator button relative to the base 60 as shown in FIGS. 1 and 2. The base stop 130 includes a locked position stop 132 for establishing the locked rotational position of the actuator button relative to the base 60 as shown in FIGS. 15 and 16.

The base 60 includes audible ribs 140 for cooperating with the actuator button 70 for audibly indicating the unlocked rotational position and the locked rotational position of the actuator button 70 relative to the base 60. More specifically, the audible ribs 140 includes an unlocked audible rib 141 for audibly indicating the unlocked rotational position of the actuator button 70 relative to the base 60 as shown in FIGS. 1 and 2. The audible ribs 140 includes a locked audible rib 142 for audibly indicating the locked rotational position of the actuator button relative to the base 60 as shown in FIGS. 15 and 16.

A groove 150 is defined in the inner ring 90 of the base 60. The groove 150 is located on a second portion of the inner ring 90 opposite the position of the bridge 98 extending across the first portion of the inner ring 90. Preferably, groove 150 has a V-shape formed by tapered sides 151 and 152 terminating in a groove bottom 154.

FIGS. 13-18 illustrate various views of the actuator button 70 shown in FIGS. 1-6. Preferably, the cylindrical sidewall 73 includes knurles 160 for assisting in the rotation of the actuator button 70 relative to the base 60. The top actuating surface 76 of the actuator button 70 may include a rotation indicator 162 for indicating the direction of rotation of the actuator button 70 relative to the base 60 between the unlocked rotational position and the locked rotational position. The actuator surface 79 extends from the rigid top actuating surface 76 of the actuator button 70.

The actuator button 70 includes a button stop 170 for cooperating with a base stop 130 for establishing the unlocked position and the locked rotational position of the actuator button 70 relative to the base 60. In this example, the button stop 170 includes a button position stop 171 and a button position stop 172.

The button position stop 172 is provided with a recess 174 and an extended projection 176. The recess 174 increases the flexibility of the extended projection 176. The extended projection 176 cooperates with the unlocked audible rib 141 and the locked audible rib 142 for audibly indicating the rotational position of the actuator button relative to the base 60.

The actuator button 70 includes a groove rib 180 extending from the inner surface 75 and the rigid top actuating surface 76 of the actuator button 70. Preferably, the groove rib 180 is formed as a one-piece unit of the actuator button 70. As will be described hereinafter, the groove rib 180 is dimensioned for insertion within the groove 150 as defined in the inner ring 90 of the base 60.

FIGS. 19-24 are various views of the prior art actuator 10 of FIGS. 1 and 2 with the actuator button 70 being located in the locked rotational position. The actuator button 70 has been rotated clockwise relative to the base 60 until the button position stop 172 of the actuator button 70 engages the locked position stop 132 of the base 60. During the clockwise rotation of the actuator button 70 to the locked rotational position, the extended projection 176 of the button position stop 172 passes over the unlocked and locked audible ribs 141 and 142 to provide two independent audible clicks. The extended projection 176 of the button position stop 172 is maintained in the locked rotational position by the locked audible ribs 142.

When the actuator button 70 is located in the locked rotational position, the terminal orifice 116 of the nozzle is covered by the sidewall 73 of the actuator button orifice 78 of the actuator button 70. The groove rib 180 engages with the inner ring 90 to prevent the actuator surface 79 of the actuator button 70 from depressing the nozzle actuating surface 118. The actuator button 70 is inhibited from tilting relative to the base 60 when the actuator button 70 is moved into the locked rotational position and is likewise inhibited from actuating the aerosol valve 20.

FIGS. 25-30 are various views of the prior art actuator 10 of FIGS. 1 and 2 with the actuator button 70 being located in the unlocked rotational position and with the actuator button 70 being in an actuated position.

The actuator button 70 has been rotated counterclockwise relative to the base 60 until the button position stop 171 of the actuator button 70 engages the unlocked position stop 131 of the base 60. During the counter clockwise rotation of the actuator button 70 to the unlocked rotational position, the extended projection 176 of the button position stop 172 passes over the unlocked and locked audible ribs 141 and 142 to provide two independent audible clicks. The extended projection 176 of the button position stop 172 is maintained in the unlocked rotational position by the unlocked audible ribs 141.

When the actuator button 70 is located in the unlocked rotational position, the terminal orifice 116 of the nozzle is aligned with the actuator button orifice 78 of the actuator button 70. The groove rib 180 is aligned with the groove 150 defined in the inner ring 90 of the base 60.

A depression of the top actuating surface 76 by an operator causes the total actuator button 70 to tilt about the bridge 98 extending across a first portion of the inner ring 90. The actuator button 70 tilts in its entirety as a unit relative to the base 60 as the groove rib 180 enters the groove 150 defined in the inner ring 90 of the base 60. A portion of the sidewall 73 of the actuator button 70 enters the void 92 between the outer ring 80 and the inner ring 90.

The tilting of the actuator button 70 causes the actuator surface 79 to depress the nozzle actuating surface 118 to actuate the aerosol valve 20. The actuator button 70 is tiltable relative to the base 60 for actuating the aerosol valve 20 to dispense the aerosol product 11 from the aerosol container 40 for discharge through the terminal orifice 116 when the actuator button 70 is rotated into the unlocked rotational position.

Figure 27:
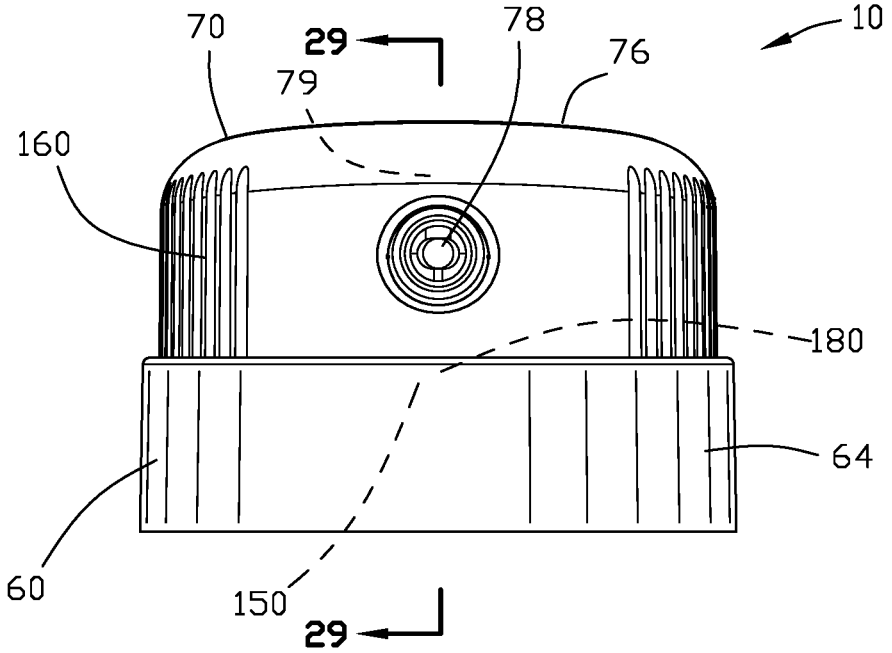
FIG. 27 Prior Art
FIG. 27 is an enlarged front view of the prior art actuator of FIG. 25.
Figure 28:
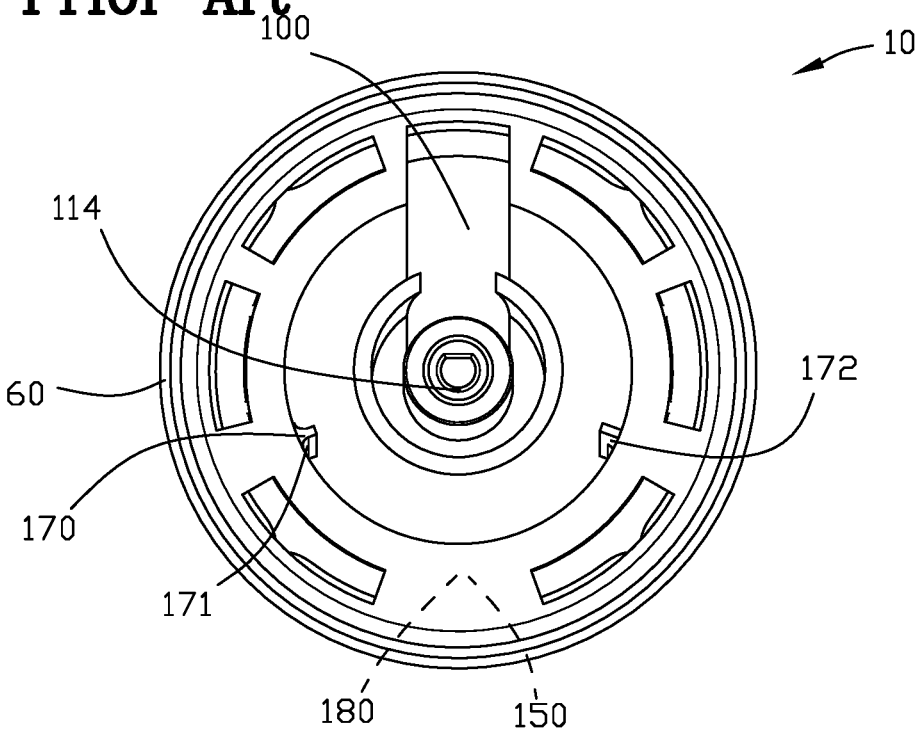
FIG. 28 is a bottom view of FIG. 27.
Figure 29:
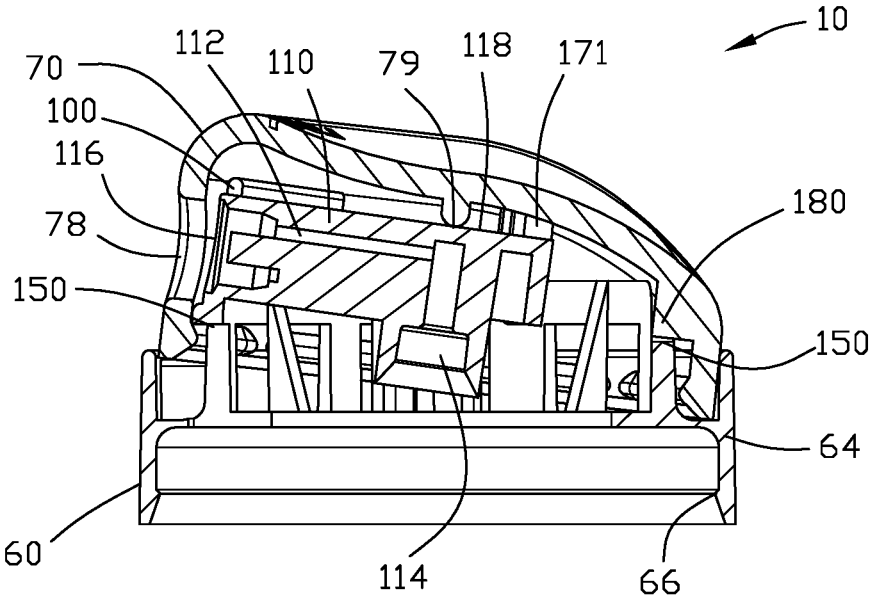
FIG. 29 Prior Art
FIG. 29 is a sectional view along line 29-29 in FIG. 27.
Figure 30:
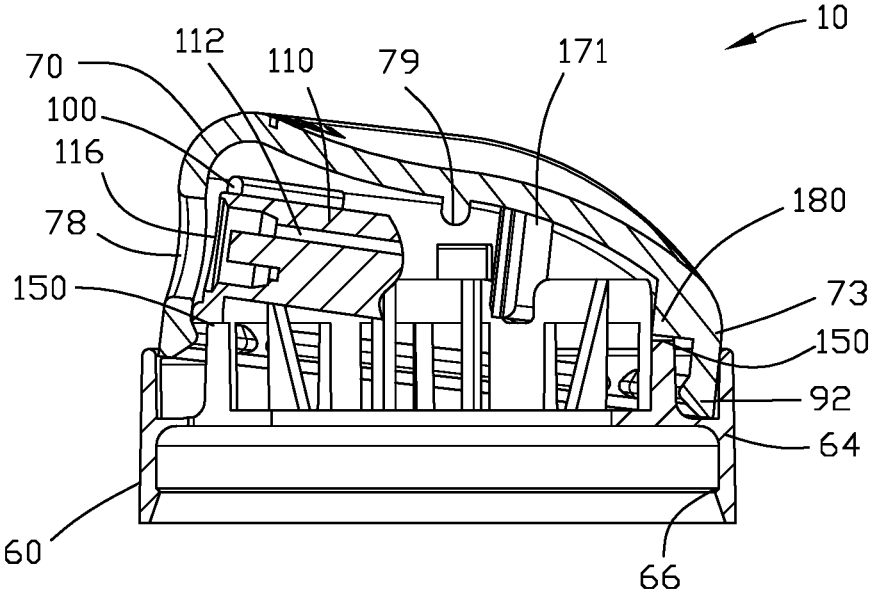
FIG. 30 is a sectional view similar to FIG. 29 with a portion of the nozzle being removed for the purpose of illustration.
Figure 31:
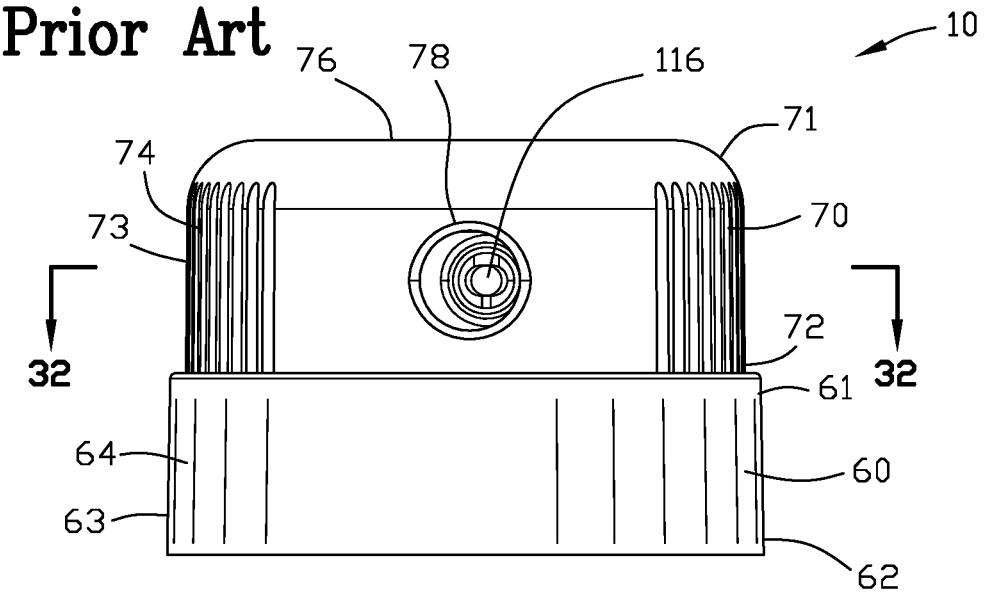
FIG. 31 Prior Art
FIG. 31 is a view similar to FIG. 27 with the aerosol actuator of the prior art shown in an unlocked operable position and illustrating a misalignment of a terminal orifice with an actuator button orifice.
Figure 32:
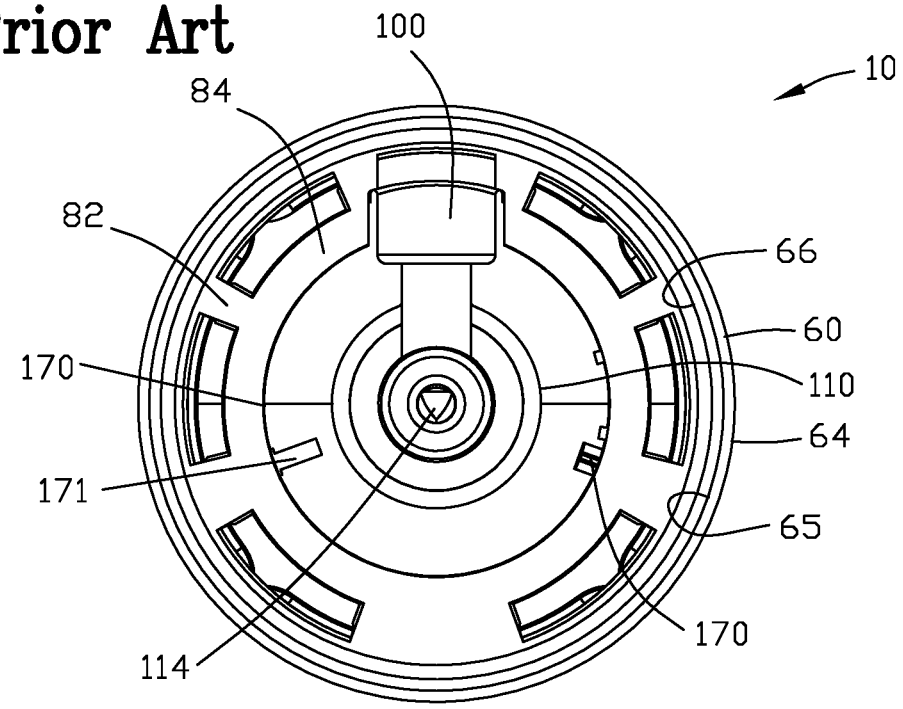
FIG. 32 is a sectional view along line 32-32 in FIG. 31.

FIG. 31 is a view similar to FIG. 27 with the aerosol actuator of the prior art shown in an unlocked operable position with FIG. 32 being a sectional view along line 32-32 in FIG. 31. In some circumstances, the actuator button 70 would move by jarring vibration or the like into a position whereat the actuator button orifice 78 was not concentric with the terminal orifice 116. This misalignment and button orifice 78 with the terminal orifice 116 was a flaw that was present in some of the products produced under U.S. Pat. No. 7,487,891.

Figure 33:
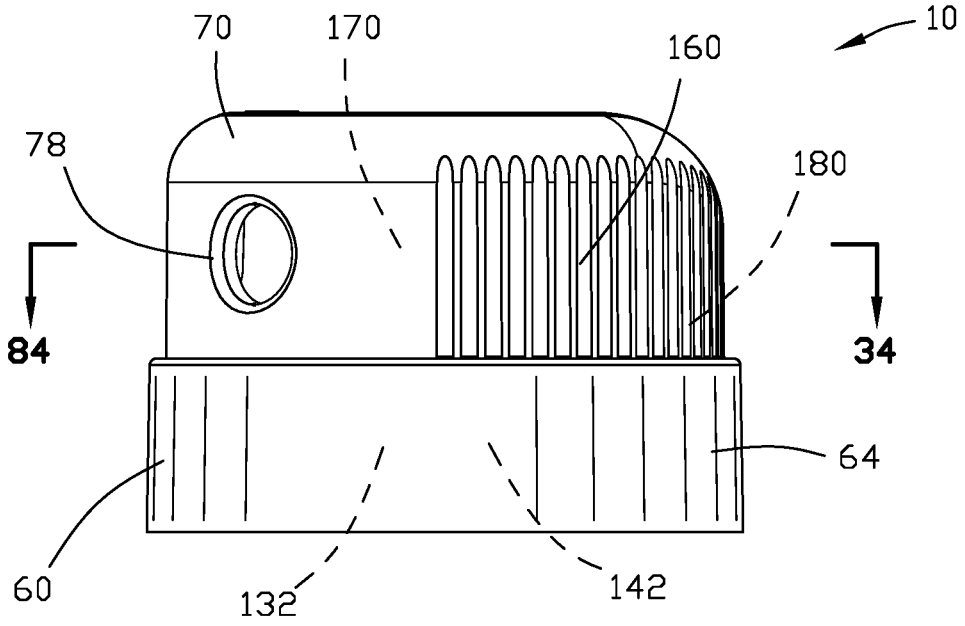
FIG. 33 Prior Art
FIG. 33 is view similar to FIG. 31 with the actuator button being located in a locked rotational position.
Figure 34:
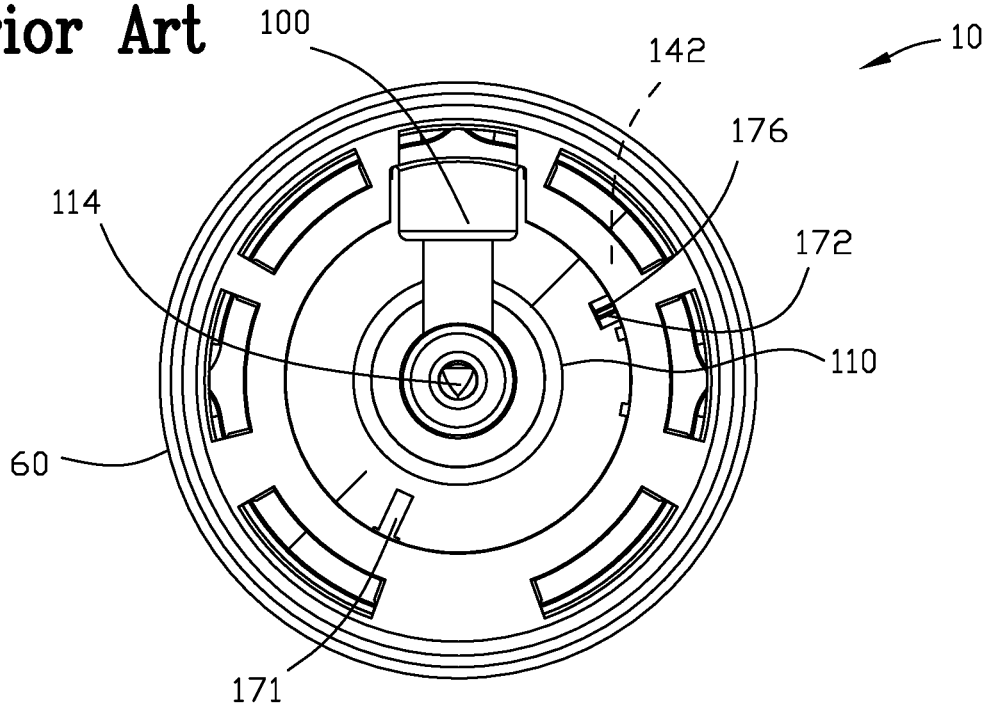
FIG. 34 is a sectional view along line 34-34 in FIG. 33.

FIGS. 33 and 34 are view similar to FIGS. 31 and 32 with the actuator button 70 being located in a locked rotational position. FIGS. 32 and 34 illustrate the pre-existing first button stop or rib 171 depending from the inner surface 75 of the actuator button 70.

It is a challenge of the present invention to correct the flaw in misalignment and button orifice 78 with the terminal orifice 116 without changing the overall appearance of the prior art actuator 10. A second challenge to overcome this flaw with minimal changes to the interior of the actuator 10.

A further desire of the present invention is to make the aerosol safety actuator 10A suitable for e-commerce shipping and distribution without requiring external wrapping of the actuator button 70 including the actuator button orifice 78 and the terminal orifice 116.

Figure 35:
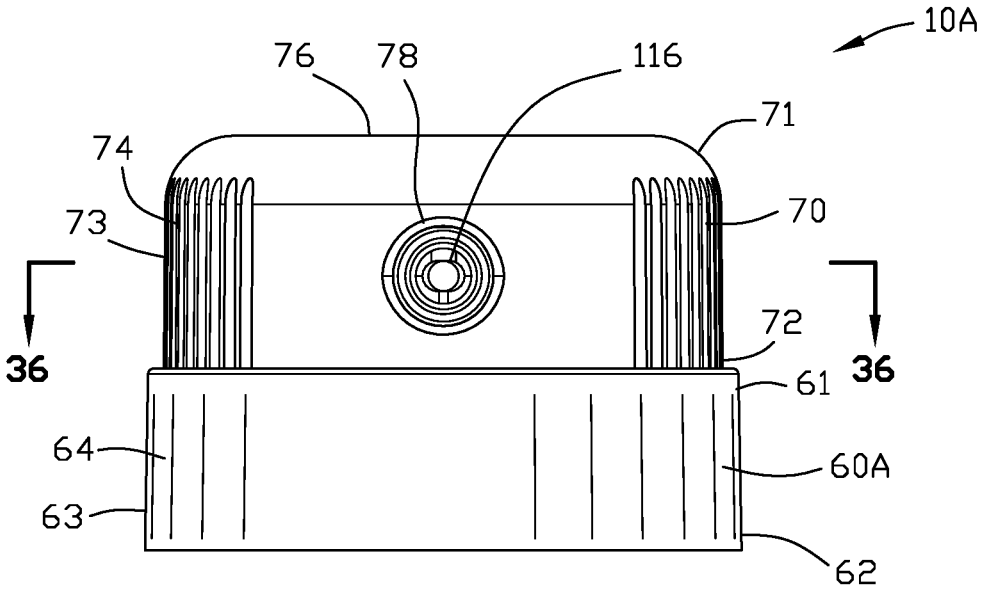
FIG. 35 is a front view of a first embodiment of the aerosol safety actuator of the present invention in an unlocked operable position.
Figure 36:
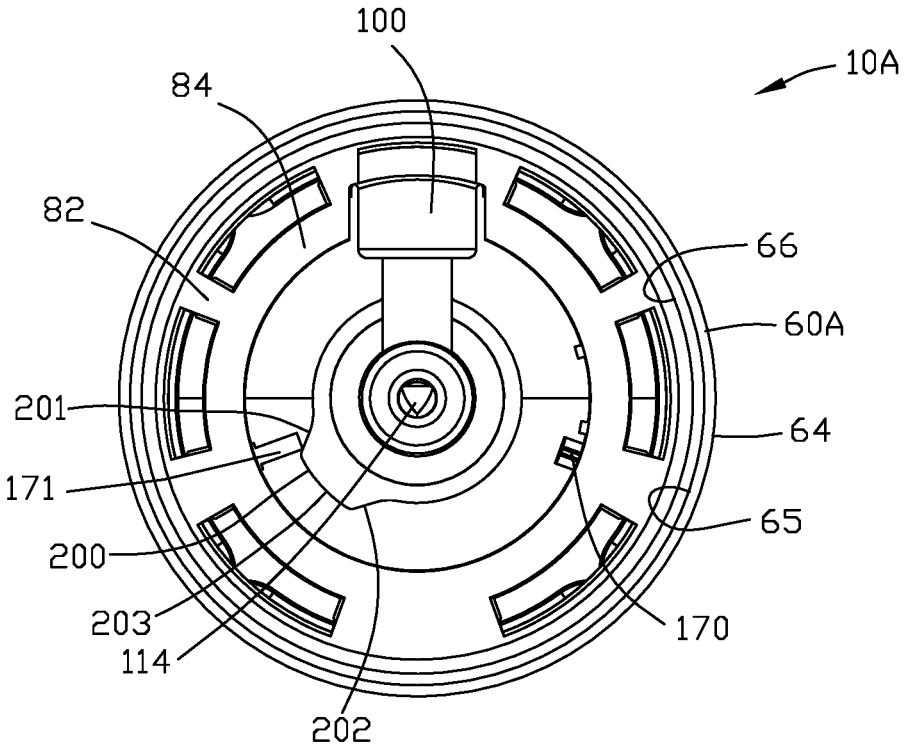
FIG. 36 is a sectional view along line 36-36 in FIG. 35.

FIG. 35 is a front view of a first embodiment of the aerosol safety actuator 10A of the present invention in an unlocked operable position with FIG. 36 being a sectional view along line 36-36 in FIG. 35.

An arcuate projection 200 has an unlocked cam shape edge 201 and a locked cam shape edge 202 coacting between the base 60A and the actuator button 70 for inhibiting unintended movement of the actuator button 70 between the unlocked rotational position and the locked rotational position. The arcuate projection 200 is unitary with the base 60A. The arcuate projection 200 extends radially outwardly relative to the axis of symmetry 13 of the base 60A from the nozzle 110 of the base 60A. The arcuate projection 200 has an arc angle substantially similar to an angle of rotational of the actuator button 70 relative to the base 60A.

The unlocked cam shape edge 201 and a locked cam shape edge 202 engage with the rib 171 extending from an underside 75 of the actuator button 70 for inhibiting unintended movement of the actuator button 70 between the unlocked rotational position and the locked rotational position. The rib 171 extending from an underside 75 of the actuator button 70 is unitary with the actuator button 70 of the prior art.

The unlocked cam shape edge 201 engaging with a rib 171 extending from an underside of the actuator button 70 urges the actuator button 70 toward the unlocked rotational position. Similarly, the locked cam shape edge 202 engaging with a rib 171 extending from an underside of the actuator button 70 urges actuator button 70 toward the locked rotational position.

Figure 37:
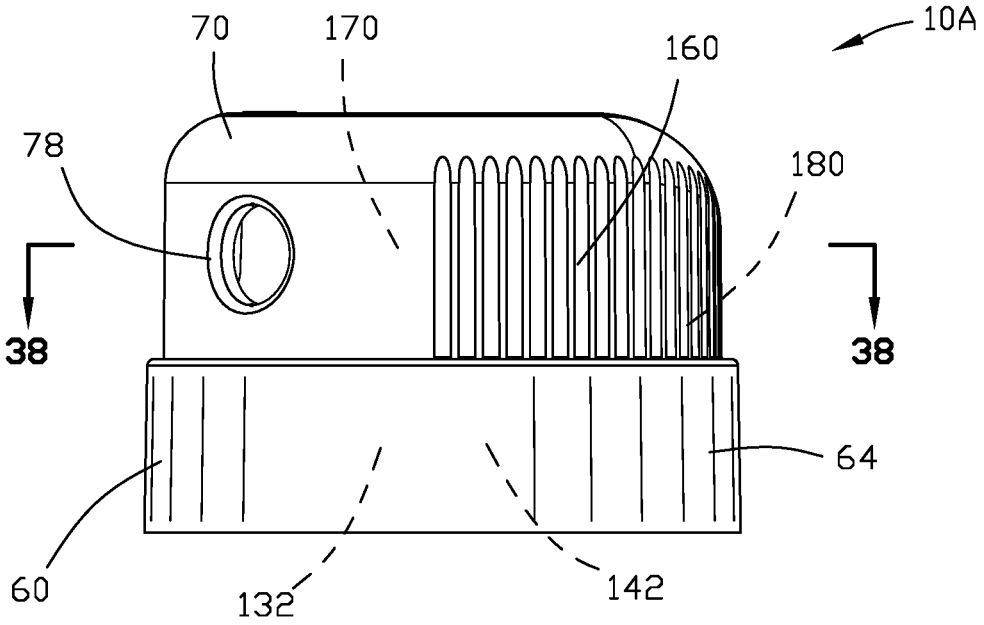
FIG. 37 is a front view similar to FIG. 35 of a first embodiment of the aerosol safety actuator of the present invention in a locked inoperable position.
Figure 38:
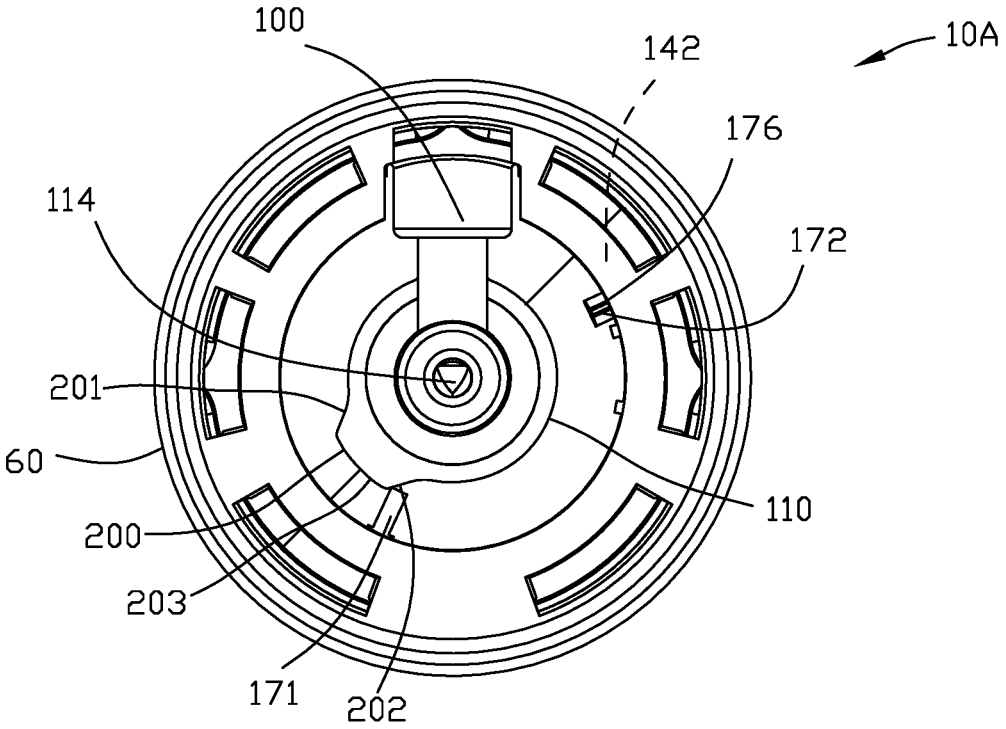
FIG. 38 is a sectional view along line 38-38 in FIG. 37.

FIG. 37 is a front view similar to FIG. 35 of a first embodiment of the aerosol safety actuator of the present invention in a locked inoperable position with FIG. 38 being a sectional view along line 38-38 in FIG. 37.

The first embodiment of the invention shown in FIGS. 31-41 has solved the problem of the misalignment and actuator button orifice 78 with the terminal orifice 116 without changing the overall appearance of the prior art actuator 10. Secondly, the first embodiment of the invention shown in FIGS. 31-41 has solved this problem with a simple modification to only the base 60A of aerosol safety actuator 10A. Thirdly, the arcuate projection 200 provides a continuous drag or frictional resistance between the unlocked rotational position and the locked rotational position. This continuous drag or frictional resistance enhances the performance for E-commerce application.

Figure 39:
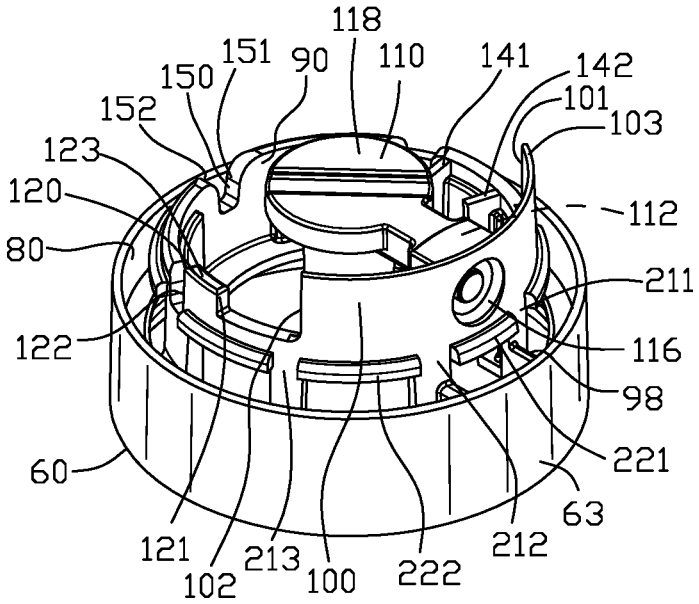
FIG. 39 Prior Art
FIG. 39 is an isometric view of the base portion of the prior art actuator of FIGS. 1-6.
Figure 40:
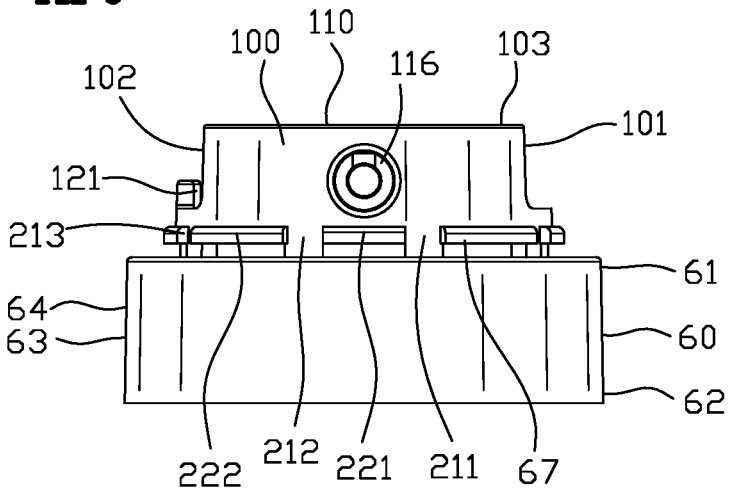
FIG. 40 is a front view of the base portion of FIG. 39.

FIGS. 39 and 40 are view of the base 60 portion of the prior art actuator of FIGS. 1-6. The base portion 60 defines the base retainer 67 for rotatably mounting an actuator button. The base retainer 67 includes a first gap 211, a second gap 212 and a third gap 213 in the base retainer 67. A first and a second friction area 221 and 222 are defined by the base retainer 67. These features of the prior art base 60 portion will be utilized by the second embodiment of the invention as will be described in greater detail hereinafter.

Figure 41:
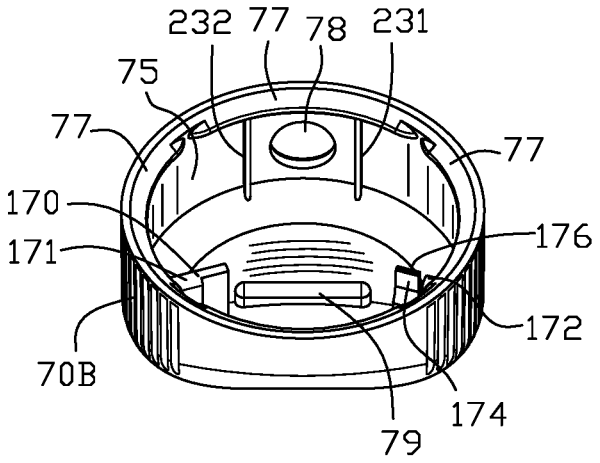
FIG. 41 is a bottom isometric view of actuator button of a second embodiment of the aerosol safety actuator of the present invention.
Figure 42:
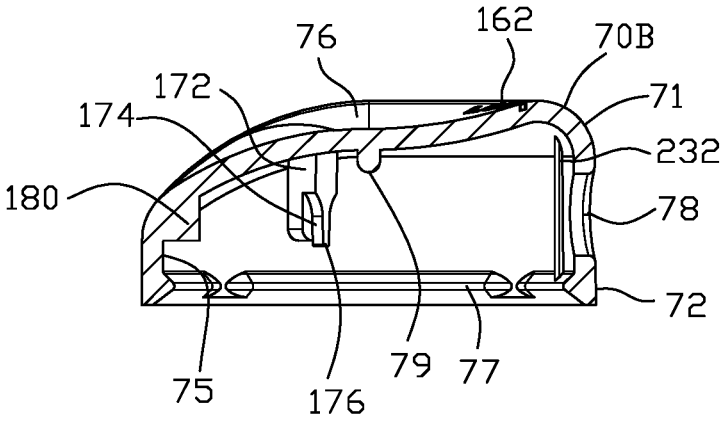
FIG. 42 is a side sectional view of the second embodiment of the aerosol safety actuator of the present invention.

FIG. 41 is a bottom isometric view of actuator button 70B of a second embodiment of the aerosol safety actuator 10B of the present invention with FIG. 42 being a side sectional view thereof. A linear projection 230 extends substantially parallel with the axis of symmetry 13 of the base 60 and extends radially inwardly from an inside surface 75B of the actuator button 70B toward the axis of symmetry 13. Although only one linear projection 230 may be used in this invention, in this example, a first and a second linear projection 231 and 232 are located in a spaced apart relation as shown in FIGS. 41-46.

Figure 43:
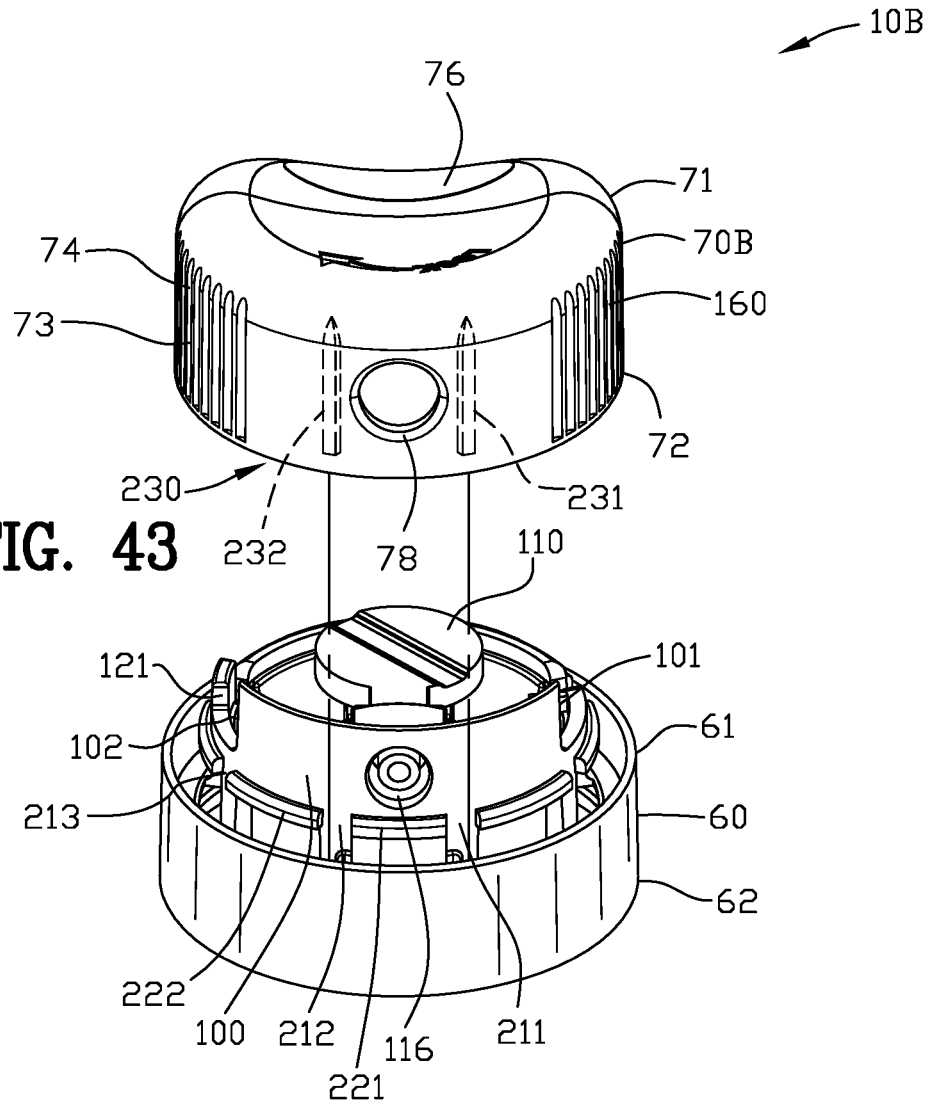
FIG. 43 is an exploded view of the actuator button of the present invention displaced from the base portion of the prior art actuator in an unlocked operable position.
Figure 44:
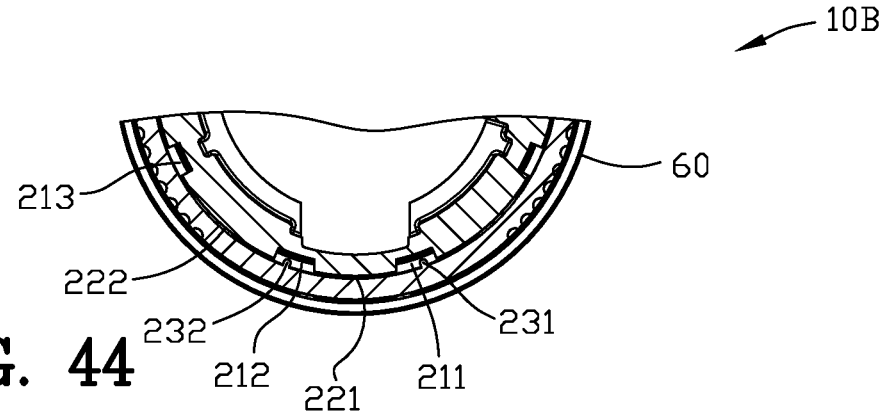
FIG. 44 is a sectional view of the actuator button of the present invention and the base portion of the prior art actuator in the unlocked operable position.

FIGS. 43 and 44 illustrate the actuator button 70B in an unlocked operable position. The first and second linear projections 231 and 232 coact between the prior art base 60 and the actuator button 70B for inhibiting unintended movement of the actuator button 70B between the unlocked rotational position and the locked rotational position. The first and second linear projections 231 and 232 are unitary with the actuator button 70B.

The first and second linear projections 231 and 232 cooperate with first and second gaps 221 and 222 in the prior art base 60 for aligning the actuator button orifice 78 with the terminal orifice 116 and for inhibiting unintended movement of the actuator button 70B from the unlocked rotational position to the locked rotational position. When the actuator button 70B is rotated from the unlocked open position as shown in FIGS. 43 and 44 toward the locked closed position, the first and second linear projections 231 and 232 ride upon the first and second friction areas 221 and 222 to add frictional resistance during the rotation of the actuator button 70B.

Figure 45:
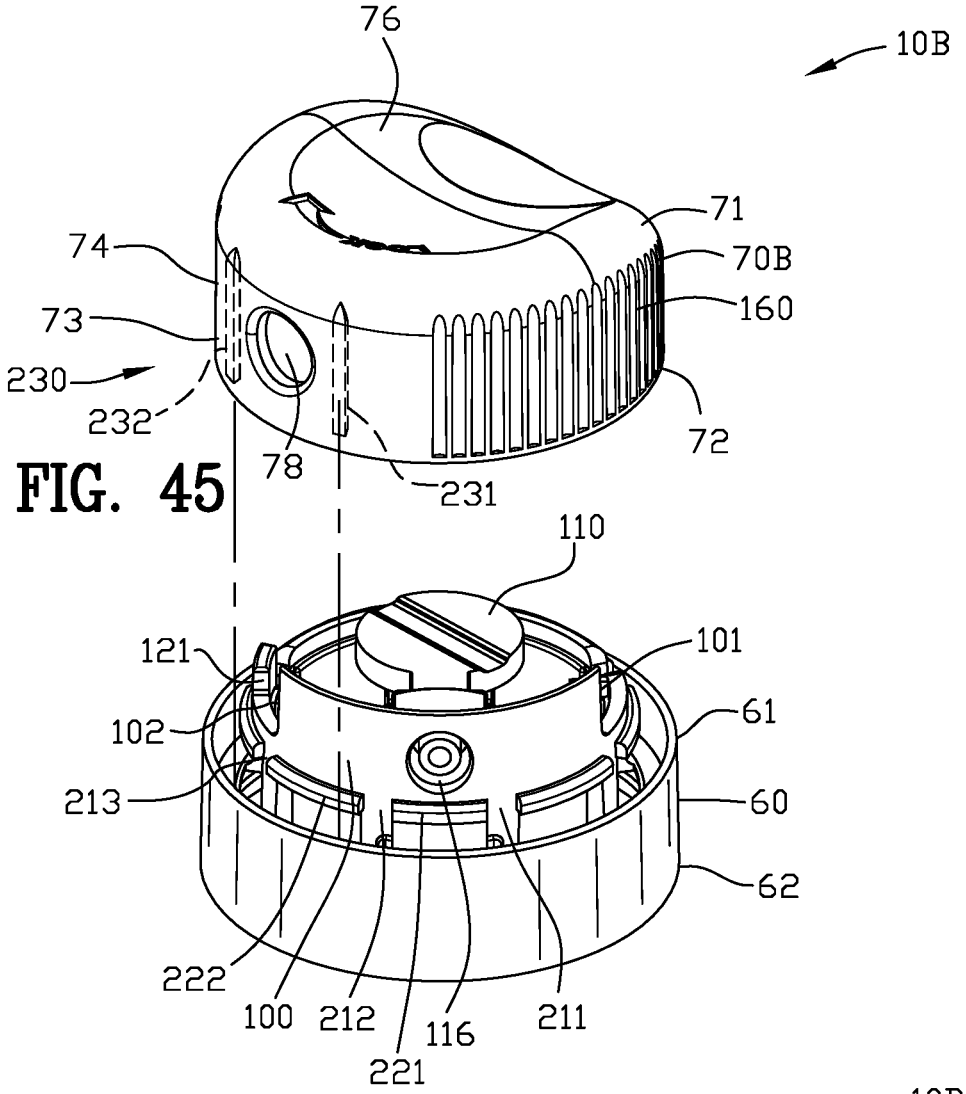
FIG. 45 is an exploded view of the actuator button of the present invention displaced from the base portion of the prior art actuator in a locked inoperable position.
Figure 46:
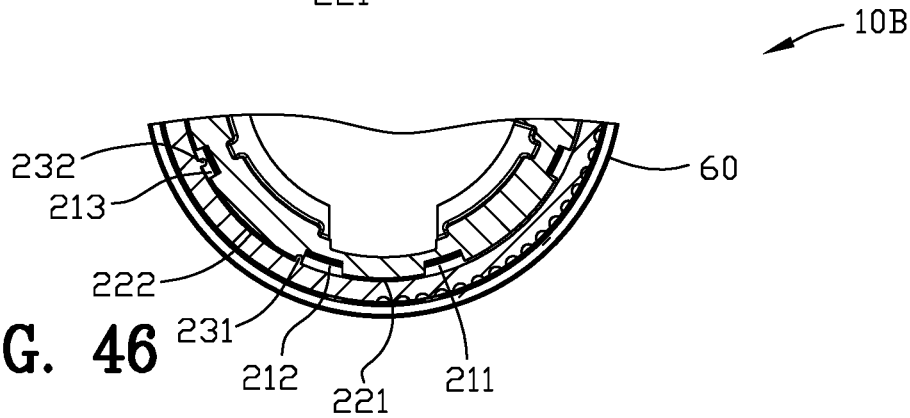
FIG. 46 is a sectional view of the actuator button of the present invention and the base portion of the prior art actuator in the locked inoperable position.

FIGS. 45 and 46 illustrate the actuator button 70B in a locked inoperable position. The first linear projection 231 frictionally engages the friction area 222 whereas the second linear projection 232 is captured by the gap 213 in the prior art base 60. The first linear projections 231 engages the second friction area 222 whereas the second linear projections 232 is captured by the third gap 213 to secure the actuator button 70B in the locked rotational position.

The first and second linear projections 231 and 232 are captured within the first and second gaps 221 and 222 in the prior art base 60 for aligning the actuator button orifice 78 with the terminal orifice 116 and for inhibiting unintended movement of the actuator button 70B from the unlocked rotational position to the locked rotational position. The first linear projection 231 engages the second friction area 222 whereas the second linear projection 232 is captured within the third gap 223 in the prior art base 60 for inhibiting unintended movement of the actuator button 70B from the locked rotational position.

This continuous drag or frictional resistance enhances the performance for E-commerce application. The linear projections 231 and 232 in combination with the gaps 211-213 and friction regions 221 and 222 increases the required torque from 0.0-0.5 inch pounds (in-lbs) to 1.5-5.0 inch pounds (in-lbs) to rotated the actuator button 70 during the opening and closing function of the improved safety actuator 10B. Typically, a 2.0 to 2.5 (in-lbs) is a minimum needed for ecommerce and for ease of use for a consumer.

The second embodiment of the invention shown in FIGS. 42-46 has solved the problem of the misalignment and actuator button orifice 78 with the terminal orifice 116 without changing the overall appearance of the prior art actuator 10. Secondly, the second embodiment of the invention shown in FIGS. 42-46 has solved this problem with a simple modification to only the actuator button 70B of aerosol safety actuator 10B. Thirdly, the linear projections 231 and 232 provide a drag or frictional resistance between the unlocked rotational position and the locked rotational position. This continuous drag or frictional resistance enhances the performance for E-commerce application.

The first embodiment of the invention shown in FIGS. 31-41 has solved the above problems with a simple modification to only the base 60A. The second embodiment of the invention shown in FIGS. 42-46 has solved the above problems with a simple modification to only the actuator button 70B. In some extreme application, it may be desirable to provide a third embodiment of the invention comprising the combination of the modification to the base 60A with the modification s to the actuator button 70B.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claims is:

1. An improved safety actuator for actuating an aerosol valve for dispensing an aerosol product from an aerosol container, comprising:

a base having an axis of symmetry of said base;

a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface with an actuator button orifice defined in said sidewall of said actuator button;

said actuator button being rotatably mounted to said base to cover said nozzle;

said actuator button being rotatable about said axis of symmetry of said base between a locked rotational position and an unlocked rotational position;

said actuator button orifice of said actuator button being aligned with said terminal orifice of said nozzle when said actuator button is rotated into said unlocked rotational position;

said unitary actuator button being movable relative to said base for engaging and pivoting said nozzle to actuate the aerosol valve for dispensing aerosol product from said terminal orifice and through said actuator button orifice defined in said sidewall of said actuator button when said actuator button is in said unlocked rotational position;

said unitary actuator button being inhibited from pivoting said nozzle when said actuator button is rotated into said locked rotational position; and a linear projection coacting between said base and said actuator button for inhibiting unintended movement of said actuator button between said unlocked rotational position and said locked rotational position.

2. The improved safety actuator for actuating an aerosol valve for dispensing an aerosol product from an aerosol container as set forth in claim 1, wherein said linear projection is unitary with said actuator button.

3. The improved safety actuator for actuating an aerosol valve for dispensing an aerosol product from an aerosol container as set forth in claim 1, wherein said linear projection is unitary with said base.

4. The improved safety actuator for actuating an aerosol valve for dispensing an aerosol product from an aerosol container as set forth in claim 1, wherein said linear projection is a unitary with said actuator button substantially parallel with said axis of symmetry of said base.

5. The improved safety actuator for actuating an aerosol valve for dispensing an aerosol product from an aerosol container as set forth in claim 1, wherein said linear projection extends radially inwardly relative to said axis of symmetry of said base.

6. An improved safety actuator for actuating an aerosol valve for dispensing an aerosol product from an aerosol container, comprising:

a base having an axis of symmetry of said base;

a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface with an actuator button orifice defined in said sidewall of said actuator button;

said actuator button being rotatably mounted to said base to cover said nozzle;

said actuator button being rotatable about said axis of symmetry of said base between a locked rotational position and an unlocked rotational position;

said actuator button orifice of said actuator button being aligned with said terminal orifice of said nozzle when said actuator button is rotated into said unlocked rotational position;

said unitary actuator button being movable relative to said base for engaging and pivoting said nozzle to actuate the aerosol valve for dispensing aerosol product from said terminal orifice and through said actuator button orifice defined in said sidewall of said actuator button when said actuator button is in said unlocked rotational position;

said unitary actuator button being inhibited from pivoting said nozzle when said actuator button is rotated into said locked rotational position; and a linear projection extending radially inwardly from and inside surface of said actuator button and substantially parallel with said axis of symmetry of said base for engaging with a portion of said base for inhibiting unintended movement of said actuator button between said unlocked rotational position and said locked rotational position.

7. The improved safety actuator for actuating an aerosol valve for dispensing an aerosol product from an aerosol container as set forth in claim 1, wherein said linear projection includes a plurality of spaced apart linear projections extending radially inwardly from and inside surface of said actuator button and substantially parallel with said axis of symmetry of said base for engaging with a portion of said base for inhibiting unintended movement of said actuator button between said unlocked rotational position and said locked rotational position.

8. The improved safety actuator for actuating an aerosol valve for dispensing an aerosol product from an aerosol container as set forth in claim 1, wherein said linear projection extends radially inwardly from and inside surface of said actuator button and substantially parallel with said axis of symmetry of said base for cooperating with a gap in said base for inhibiting unintended movement of said actuator button between said unlocked rotational position and said locked rotational position.

9. An improved safety actuator for actuating an aerosol valve for dispensing an aerosol product from an aerosol container, comprising:

a base having an axis of symmetry of said base;

a mounting for securing said base to the aerosol container;

a nozzle defining a nozzle channel extending between the aerosol valve and a terminal orifice;

said nozzle being flexibly mounted to said base for enabling said nozzle to pivot for actuating the aerosol valve;

a unitary actuator button comprising a rigid sidewall supporting a rigid top actuating surface with an actuator button orifice defined in said sidewall of said actuator button;

said actuator button being rotatably mounted to said base to cover said nozzle;

said actuator button being rotatable about said axis of symmetry of said base between a locked rotational position and an unlocked rotational position;

said actuator button orifice of said actuator button being aligned with said terminal orifice of said nozzle when said actuator button is rotated into said unlocked rotational position;

said unitary actuator button being movable relative to said base for engaging and pivoting said nozzle to actuate the aerosol valve for dispensing aerosol product from said terminal orifice and through said actuator button orifice defined in said sidewall of said actuator button when said actuator button is in said unlocked rotational position;

said unitary actuator button being inhibited from pivoting said nozzle when said actuator button is rotated into said locked rotational position;

a linear projection extending radially inwardly from and inside surface of said actuator button and substantially parallel with said axis of symmetry of said base for engaging with a portion of said base for inhibiting unintended movement of said actuator button between said unlocked rotational position and said locked rotational position, an unlocked rotational position stop and a locked rotational position stop for limiting rotational movement of said actuator button relative to said base;

said linear projection extending radially inwardly from and inside surface of said actuator button and substantially parallel with said axis of symmetry of said base for cooperating with a gap in said base and with said unlocked rotational position stop to secure said actuator button in said unlocked rotational position; and said linear projection for cooperating with a gap said base and cooperating with said locked rotational position stop to secure said actuator button in said locked rotational position.

10. The improved safety actuator for actuating an aerosol valve for dispensing an aerosol product from an aerosol container as set forth in claim 1, wherein said linear projection includes a plurality of spaced apart linear projections extending radially inwardly from and inside surface of said actuator button and substantially parallel with said axis of symmetry of said base; and said plurality of spaced apart linear projections having an are spacing commensurate with the angle of rotation between said unlocked rotational position and said locked rotational position.

11. The improved safety actuator for actuating an aerosol valve for dispensing an aerosol product from an aerosol container as set forth in claim 1, wherein said linear projection extends radially inwardly from and inside surface of said actuator button and substantially parallel with said axis of symmetry of said base for engaging with said base for inhibiting depression of said actuator button between said unlocked rotational position and said locked rotational position, and said linear projection cooperating with a gap in said base for permiting depression of said actuator button in said unlocked rotational position.

12. An improved safety actuator for actuating an aerosol valve for dispensing an aerosol product from an aerosol container, comprising:

a base having an axis of symmetry of said base;

a mounting for securing said base to the aerosol container, a nozzle defining a nozzle channel extending between the aerosol valve and a terminal orifice;

an actuator button comprising a rigid sidewall supporting a rigid top actuating;

said nozzle being mounted for enabling said nozzle to pivot for actuating the aerosol valve;

said actuator button being rotatably mounted to said base;

said actuator button being rotatable about said axis of symmetry of said base between a locked rotational position and an unlocked rotational position;

said actuator button being movable relative to said base for pivoting said nozzle to actuate the aerosol valve for dispensing aerosol product from said terminal orifice when said actuator button is in said unlocked rotational position;

said unitary actuator button being inhibited from pivoting said nozzle when said actuator button is rotated into said locked rotational position; and a linear projection coacting between said base and said actuator button for engaging with a portion of said base for inhibiting unintended movement of said actuator button between said unlocked rotational position and said locked rotational position.

13. An improved safety actuator for actuating an aerosol valve for dispensing an aerosol product from an aerosol container, comprising:

a base having an axis of symmetry of said base;

a mounting for securing said base to the aerosol container;

a nozzle defining a nozzle channel extending between the aerosol valve and a terminal orifice;

an actuator button comprising a rigid sidewall supporting a rigid top actuating;

said nozzle being mounted for enabling said nozzle to pivot for actuating the aerosol valve;

said actuator button being rotatably mounted to said base;

said actuator button being rotatable about said axis of symmetry of said base between a locked rotational position and an unlocked rotational position;

said actuator button being movable relative to said base for pivoting said nozzle to actuate the aerosol valve for dispensing aerosol product from said terminal orifice when said actuator button is in said unlocked rotational position;

said unitary actuator button being inhibited from pivoting said nozzle when said actuator button is rotated into said locked rotational position;

a linear projection coacting between said base and said actuator button for engaging with a portion of said base for inhibiting unintended movement of said actuator button between said unlocked rotational position and said locked rotational position;

linear projection extending radially inwardly from and inside surface of said actuator button and substantially parallel with said axis of symmetry of said base for engaging with said base for inhibiting unintended movement of said actuator button between said unlocked rotational position and said locked rotational position, and said linear projection cooperating with a gap in said base for permitting movement of said actuator button in said unlocked rotational position.

* * * * *